US005593044A

United States Patent [19]

Yamashita et al.

[11] Patent Number: 5,593,044

[45] Date of Patent: Jan. 14, 1997

[54] APPARATUS FOR SORTING SHEETS OR THE LIKE

[75] Inventors: Taichiro Yamashita; Yasunori Hamada, both of Tsuchiura; Kazushi Yoshida, Ibaraki-ken; Tadashi Osaka, Ibaraki-ken; Junichi Tamamoto, Ibaraki-ken, all of Japan

[73] Assignee: Hitachi, Ltd., Tokyo, Japan

[21] Appl. No.: 362,877

[22] Filed: Dec. 23, 1994

[30] Foreign Application Priority Data

Dec. 28, 1993 [JP] Japan ..... 5-334947

[51] Int. Cl.[6] ..... B07C 5/36; B65H 85/00

[52] U.S. Cl. ..... 209/584; 209/900; 271/3.12

[58] Field of Search ..... 209/554, 563, 209/564, 569, 583, 584, 900; 271/2, 3, 3.01, 4.01, 149, 163, 218, 3.12, 3.13

[56] References Cited

U.S. PATENT DOCUMENTS 5,097,959 3/1992 Tilles et al. ..... 209/584

5,324,927 6/1994 Williams ..... 209/584 X 5,363,971 11/1994 Weeks et al. ..... 209/900 X

FOREIGN PATENT DOCUMENTS 8403680 7/1986 Netherlands ..... 209/584

*Primary Examiner*—William E. Terrell

*Assistant Examiner*—Tuan Nguyen

*Attorney, Agent, or Firm*—Antonelli, Terry, Stout & Kraus, LLP

[57] ABSTRACT

An apparatus for sorting sheet-like items, in which the items, which are to be sorted to plural collecting sections, can be easily recycled to a feeder for sorting the items in multiple sorts in accordance with a desired sorting order or sequence. A stacker is provided on an upper portion of feeder. By pulling out a bottom plate of the stacker, the once sorted items in the stacker are caused to fall down into the feeder. The items can thus be rapidly recycled to the feeder for another sort, thereby reducing the time required for complete sorting or sequencing of the mail.

17 Claims, 21 Drawing Sheets

| STACKING SECTION | ADDRESS |
|---|---|
| 1 | FIRST STREET |
| 2 | SECOND STREET |
| 3 | THIRD STREET |
| ⋮ | ⋮ |
| 11 | FIRST AVENUE |
| 12 | SECOND AVENUE |

14

APPARATUS FOR SORTING SHEETS OR THE LIKE

BACKGROUND OF THE INVENTION

The present invention relates to an apparatus for sorting sheets or the like, which reads address codes, e.g., bar codes, applied to the sheets or the like such as mail, and distributes the introduced sheets or the like in accordance with the address codes. More particularly, the invention relates to an apparatus for sorting sheets or the like which enables carrier route sequencing of mail, i.e., sequencing the volume of mail by carrier route in accordance with address codes.

A conventional apparatus for reading address codes applied to sheets or the like such as mail and sequencing the incoming sheets or the like in the order indicated by the address codes is, for example, a carrier route sequencing system for sheets or the like which is disclosed in Japanese Patent Unexamined Publication No.63-287584.

In this conventional system, addresses of delivery points of sheets or the like are inputted, and the sheets or the like are sorted into portions corresponding to delivery zones in accordance with the inputted addresses. During this operation, the addresses and the number of fed sheets or the like for each of the delivery zones are stored in a storage unit. Then, the stored addresses are sequenced into the carrier route order and stored again. Next, each of the portions of the sheets or the like sorted in accordance with the delivery zones are taken out of stacking means and supplied to feeder means again. After that, the addresses are read again and checked with the addresses in the carrier route order stored in the storage unit, thus sorting the sheets or the like in accordance with the carrier route order.

In the above-described conventional technology, sheets or the like, such as mail, sorted and received in sections of the stacking means must be taken out and returned to the feeder means so as to perform carrier route sequencing. For this purpose, there are employed recycle means for shifting the sorted sheets or the like from the stacking means to the feeder means. In this case, in order to supply the sorted mail in the stacking means to the feeder means again, the mail taken out of the stacking means must be transferred about 3 to 6 m from the stacking means to the feeder means.

However, supposing the number of mail per deliverer is about 1000, the weight of the mail is totally about 10 kg, and consequently, for example, it is necessary to prepare trays for containing the mail in the vicinity of the stacking means, to introduce the sorted mail into the trays carefully without changing the order of the mail, to carry the trays to the vicinity of the feeder means, and to supply the mail to the feeder means successively in order. Such operations require much labor and time and involve a problem that if an error occurs in the order of the mail when moving the mail into or out of the trays, correct carrier route sequencing can not be carried out.

SUMMARY OF THE INVENTION

An object of the present invention is to provide an apparatus for sorting sheets or the like which can improve the efficiency of sequencing sorted mail into carrier route order.

In order to achieve the above object, one characteristic of the present invention resides in an apparatus for sorting sheets or the like, comprising: feeder means which hold a plurality of sheets or the like in standing positions; separation means (or singulating means) for taking up (or singulating) the sheets or the like one by one from the feeder means; address code reading means for reading address codes applied to the sheets or the like which have been taken up by the separation means; stacking means provided on an upper portion of the feeder means, the stacking means including a plurality of stacking sections in which the sheets or the like are stacked in standing positions; conveyer means for the sheets or the like which connect the separation means and the stacking means; and sheets or the like sorting means for sorting the sheets or the like to any of the stacking sections of the stacking means in accordance with the address codes which have been read by the address code reading means.

In this case, preferably, the apparatus further includes switch-back means for reversing the direction of conveyance of the sheets or the like, the switch-back means being provided in the middle of the conveyer means.

Further, preferably, the address code reading means consist of first address code reading means for reading address codes applied to the front surfaces of the sheets or the like which have been taken up by the separation means, and second address code reading means for reading address codes applied to the back surfaces of the sheets or the like which have been taken up by the separation means, and the sorting means sort the sheets or the like to any of the stacking sections of the stacking means in accordance with the address codes which have been read by the first address code reading means or the second address code reading means.

Preferably, the stacking means further include sheet or the like shifting means by which the sheets or the like held in substantially standing positions in the stacking means are shifted into the feeder means so as to be held in standing positions and moved to the separation means without changing the order of the sheets or the like when they were shifted to the stacking means.

Preferably, the stacking means further include bottom-surface moving means which let the sheets or the like in standing positions in the stacking means fall down into the feeder means. In this case, it is effective that the feeder means include sheet or the like moving means for moving the sheets or the like held in standing positions in the feeder means, toward the separation means.

Preferably, the feeder means which hold the sheets or the like in standing positions are replaced with feeder means which hold a plurality of sheets or the like in standing or horizontal positions, and the stacking means in which the sheets or the like are stacked in standing positions are replaced with stacking means including a plurality of stacking sections in which the sheets or the like are stacked in standing or horizontal positions, and also, the stacking means include bottom-surface moving means which let the sheets or the like in the stacking means fall down into the feeder means, and the feeder means include bottom-surface moving means for raising the bottom surface thereof toward the bottom surface of the stacking means and returning it to the original position.

It is effective that the stacking means are first stacking means including a plurality of stacking sections in which the sheets or the like are stacked in standing positions, which first stacking means can shift the sheets or the like to the feeder means, and the sheet or the like sorting means are first sheet or the like sorting means, and the apparatus further includes second distributing means for distributing the sheets or the like to the second stacking means. In this case, preferably, the plurality of processing segments are such that the number of the sheets or the like belonging to each of the processing segments is not more than the number which can be placed in the feeder means at one time.

With this structure, it is effective that the apparatus further includes thickness measuring means for measuring the thickness of the sheets or the like; a first storage unit for storing the thickness of the sheets or the like which have been measured by the thickness measuring means and the address codes of the sheets or the like which have been read by the address code reading means; sequencing means for sequencing the address codes and the thickness of the sheets or the like in the first storage unit into the serial order of the address codes; a second storage unit for storing the address codes and the thickness of the sheets or the like produced from the sequencing means, in the serial order of the address codes; and control means by which when the total thickness of the sheets or the like is larger than the thickness which can be placed in the feeder means at one time, the address codes stored in the second storage unit are divided into a plurality of continuous processing segments, a plurality of the sheets or the like supplied to the feeder means are taken up one by one by the separation means, the address codes are read by the address code reading means, and sheets or the like whose read address codes are not in the first one of the processing segments, are stacked in the second stacking means. In this case, preferably, the total thickness of the sheets or the like belonging to each of the processing segments is not more than the thickness which can be placed in the feeder means at one time.

With the structure having the first and second distributing means, it is effective that the apparatus further includes thickness measuring means for measuring the thickness of the sheets or the like; a first storage unit for storing the thickness of the sheets or the like which have been measured by the thickness measuring means and the address codes of the sheets or the like which have been read by the address code reading means; sequencing means for sequencing the address codes and the thickness of the sheets or the like in the first storage unit into the serial order of the address codes; a second storage unit for storing the address codes and the thickness of the sheets or the like produced from the sequencing means, in the serial order of the address codes; a third storage unit for storing correspondence between the stacking sections of the first stacking means and digits in any of the positions which constitute the address codes; and control means by which when the total thickness of the sheets or the like inputted from the second storage unit is larger than the thickness which can be placed in the feeder means at one time, the address codes are divided into a plurality of continuous processing segments, provided with processing segment symbols and stored in the second storage unit, a plurality of the sheets or the like supplied to the feeder means are taken up one by one by the separation means, the address codes are read by the address code reading means, and sheets or the like whose read address codes are not in the first one of the processing segments, are stacked in the second stacking means, the thickness of the sheets or the like corresponding to the address codes having a common digit in any of a plurality of positions of the address codes is summed up, and when the total thickness of the sheets or the like is larger than the thickness which can be stacked in each of the stacking sections, common sorting information is allotted to two continuous stacking sections and stored in the third storage unit.

Similarly, with the structure having the first and second distributing means, it is preferred that the apparatus further includes thickness measuring means for measuring the thickness of the sheets or the like; a first storage unit for storing the thickness of the sheets or the like which have been measured by the thickness measuring means and the address codes of the sheets or the like which have been read by the address code reading means; sequencing means for sequencing the address codes and the thickness of the sheets or the like in the first storage unit into the serial order of the address codes; a second storage unit for storing the address codes and the thickness of the sheets or the like produced from the sequencing means, in the serial order of the address codes; and control means by which address codes of sheets or the like to be delivered with priority are obtained in advance, a plurality of the sheets or the like supplied to the feeder means are taken up one by one by the separation means, the address codes are read by the address code reading means, and sheets or the like whose read address codes are not the address codes for sorting with priority are received in the second stacking means.

It is effective that the stacking means are means including a plurality of stacking sections in which the sheets or the like are stacked in standing positions, which stacking means can shift the sheets or the like to the feeder means, and the apparatus further includes display means for displaying, for each of the stacking sections, a range of the address codes of the sheets or the like stacked in the stacking section when sequencing of the sheets or the like is completed.

Further, it is effective that the stacking means are means including a plurality of stacking sections in which the sheets or the like are stacked in standing positions, which stacking means can shift the sheets or the like to the feeder means, and the apparatus further includes display means which correspond to the respective stacking sections and are provided in the vicinity of the stacking sections, each of which display means displays address codes of sheets or the like stacked in the nearest adjacent stacking section when sequencing of the sheets or the like is completed.

Moreover, it is effective that the stacking means are means including a plurality of stacking sections in which the sheets or the like are stacked in standing positions, which stacking means can shift the sheets or the like to the feeder means, and the apparatus further includes control means by which the stacking sections of the stacking means are associated with digits in a predetermined position of the address codes in normal order or reverse order, a plurality of the sheets or the like supplied to the feeder means are taken up one by one by the separation means, and are distributed to the stacking sections of the stacking means in accordance with the address codes read by the address code reading means, the sheets or the like are shifted from the stacking means to the feeder means so as to be fed to the separation means again, and a series of the foregoing operations are repeated and controlled. In this case, preferably, the apparatus further includes control means by which the series of operations starts with associating digits in the first position from the right of a plurality of positions of the address codes in normal order or reverse order, with the respective stacking sections of the stacking means, and every time the series of operations is repeated, digits in the next position of the address codes to the left of the former position are associated with the respective stacking sections of the stacking means, and the order of the digits in the position of the address codes corresponding to the stacking sections is reversed, and the series of operations is repeated as many times as the number of digit positions of the address codes so that a plurality of the sheets or the like discriminated by the address codes can be sequenced into normal order or reverse order of the address codes.

Another characteristic of the present invention resides in an apparatus for sorting sheets or the like, comprising: feeder means which hold a plurality of sheets or the like; separation means for taking up the sheets or the like one by one from the feeder means; address code reading means for reading address codes applied to the sheets or the like which have been taken up by the separation means; stacking means provided on an upper portion of the feeder means, the stacking means including a plurality of stacking sections in which the sheets or the like are stacked; conveyer means for the sheets or the like which connect the separation means and the stacking means; sheet or the like distributing means for distributing the sheets or the like to any of the stacking sections of the stacking means in accordance with the address codes which have been read by the address code reading means; and means for shifting the sheets or the like in the stacking means to the feeder means, the shift means being provided between the stacking means and the feeder means.

Since the stacking unit is provided on the upper portion of the feeder means, the sheets or the like sorted to the stacking sections of the stacking means can be shifted from the stacking unit on an upper shelf to the feeder means on a lower shelf when the sheets or the like are supplied to the feeder means again. As a result, the operational efficiency of the carrier route sequencing can be improved.

In this specification of the invention, in the feeder means letters are accumulated. The separation means are a mechanism consisting of a rotating belt for taking up letters one by one from the feeder means and conveying it. The first address code reading means and the second address code reading means are mechanisms for reading bar codes or the like, such as bar code readers and OCR devices. The first stacking means are a box structure divided by a plurality of partitions and consist of a plurality of stacking sections. The letters which have been conveyed by the belt are distributed to the stacking sections in accordance with their addresses. The second stacking means are a mechanism similar to the first stacking means, and letters rejected by the first stacking means are stacked in the second stacking means. The conveyer means are, for example, a belt. The switch-back means reverse the advancing direction of letters. The sheet or the like distributing means are switch devices for the advancing direction of the letters.

According to the present invention, the sheets or the like to which address codes are applied, such as mail, can be sequenced into the order indicated by the address codes, and the efficiency of such carrier route sorting operation can be improved.

DETAILED DESCRIPTION OF THE INVENTION

The preferred embodiments of the present invention will be hereinafter described with reference to the attached drawings.

Figure 1:
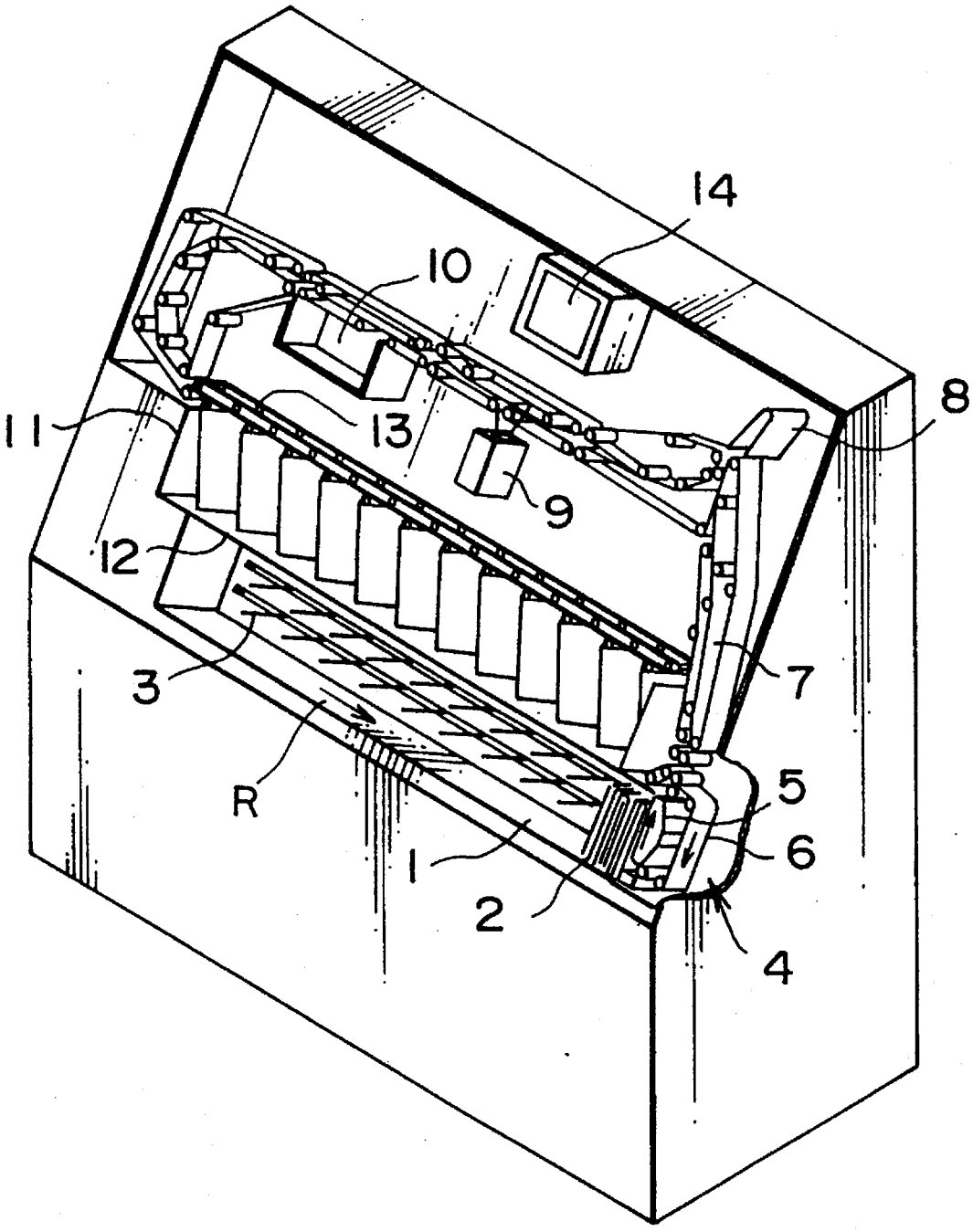
FIG. 1 is a perspective view showing one embodiment of an apparatus for sorting sheets or the like according to the present invention.

FIG. 1 is a perspective view showing one embodiment of an apparatus for sorting sheets or the like according to the invention. In FIG. 1, reference numeral 1 denotes feeder means which can hold a plurality of sheets or the like 2 in standing positions, and 3 denotes forks which are supported along the feeder means 1 so as to move in a direction indicated by the arrow R. The forks 3 can move the sheets or the like 2 in the direction of the arrow R while pressing the sheets or the like 2.

Reference numeral 4 denotes separation means which can take up only the right-end one of the sheets or the like 2 placed on the feeder means 1 and convey it upwardly. Such sheet or the like separation means are generally of the suction type with a vacuum suction belt. A vacuum chamber 5 is maintained under a negative pressure to suck and attach each sheet or the like 2 to a suction belt 6, and the suction belt 6 is rotated by drive means such as a motor, so that only the right-end one of the sheets or the like 2 can be separated and conveyed upwardly.

Reference numeral 7 denotes a conveyer passage in which the sheets or the like 2 can be conveyed. In the conveyer passage 7, for example, the front and back surfaces of each sheet or the like 2 taken up by the separation means 4 are held between belts and conveyed. Reference numeral 8 denotes a switch-back or revering device provided in the conveyer passage 7, whereby the advancing direction of the sheets or the like 2 is reversed.

Reference numeral 9 denotes first address code reading means which read address codes, e.g., bar codes, applied to the sheets or the like 2 beforehand.

Reference numeral 10 denotes a sheets or the like discharge portion. The sheets or the like 2 whose address codes were unreadable, the sheets or the like 2 whose address codes were erroneously read, and the sheets or the like 2 which were judged to be unsuitable for conveyance, are discharged from the conveyer passage 7 and stacked in the sheets or the like discharge portion 10.

Reference numeral 11 denotes first stacking means in which the sheets or the like 2 after reading are stacked. The first stacking means 11 are provided closely above the feeder means 1. The inside space of the first stacking means 11 is partitioned into stacking sections, e.g., S1 to S12, in each of which the sheets or the like 2 can be held in substantially standing positions. Reference numeral 12 denotes a bottom plate of the first stacking means 11.

Reference numeral 13 denotes first distributing means which distribute the sheets or the like 2 to the stacking sections of the first stacking means 11 in accordance with the address codes read by the address code reading means 9. Reference numeral 14 denotes a display device for displaying information about address codes and so forth.

Figure 2:
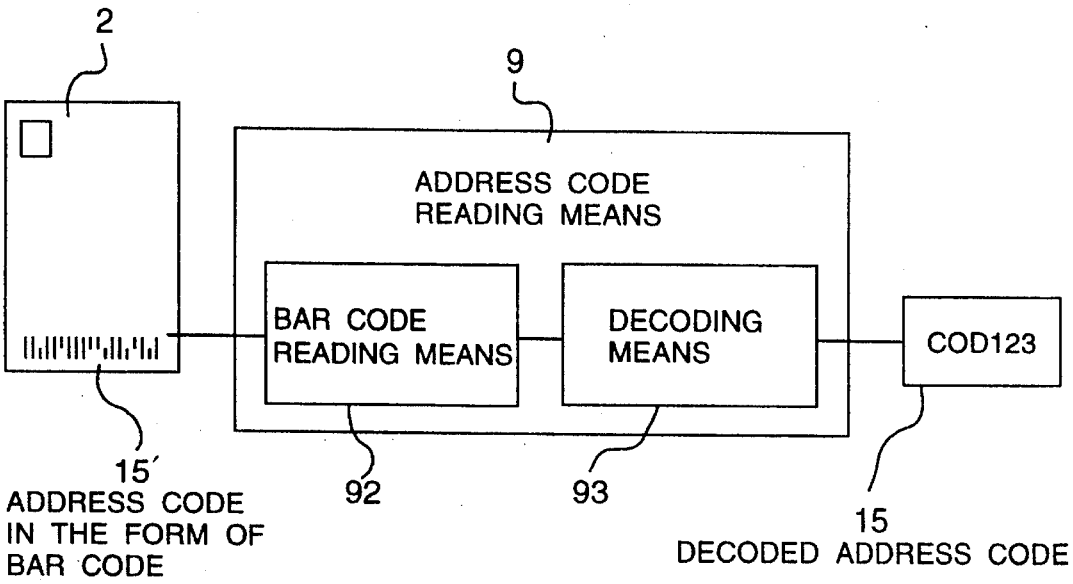
FIG. 2 is a diagram showing an address code and one example of the structure of address code reading means which constitute the sheet or the like sorting apparatus of the invention.

FIG. 2 is a diagram showing an address code applied to a sheet or the like beforehand, and one example of the structure of the address code reading means 9 according to the present invention. In FIG. 2, reference numeral 15' denotes the address code applied to the sheet or the like 2 in the form of, e.g., a bar code which can represent numerals and symbols by the length of the bars. Reference numeral 92 denotes bar code reading means provided inside of the address code reading means 9. The and the bar code reading means 92 can read the address code 15' in the form of a bar code. Reference numeral 93 denotes decoding means which can decode the address code 15' which has been read by the bar code reading means 92 into the original numerals and symbols, and 15 denotes the decoded address code expressed by the original numerals and symbols.

Figure 3:
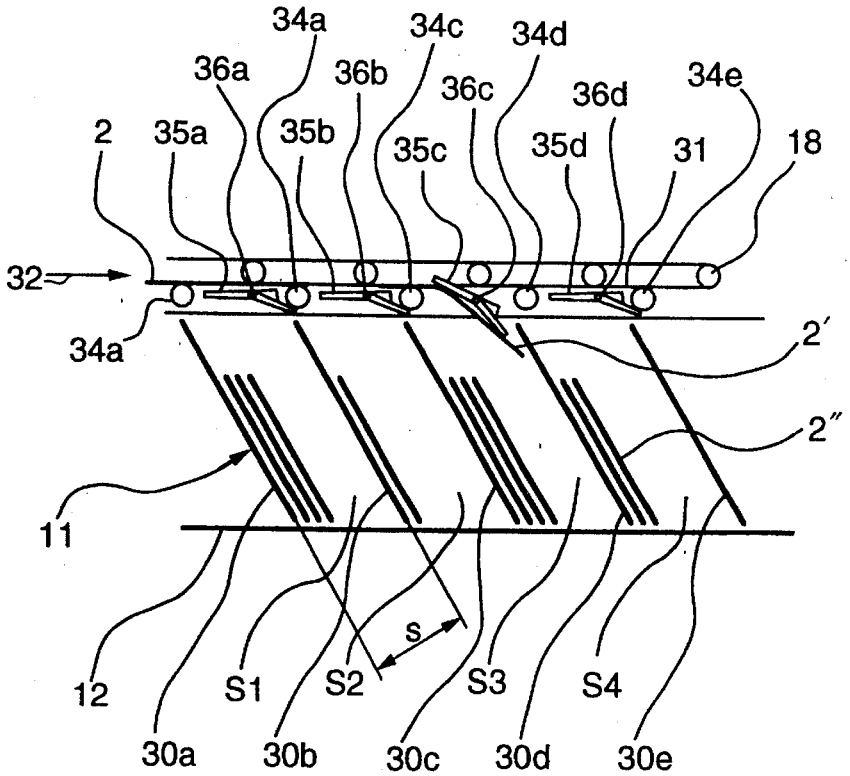
FIG. 3 is a front view showing one example of the structure of first stacking means and first distributing means which constitute the sheet or the like sorting apparatus of the invention.

FIG. 3 is a front view showing one example of the structure of the first stacking means 11 and the first distributing means 13 according to the invention. In FIG. 3, reference numerals 30*a*, 30*b*, 30*c*. . . denote partitions which define stacking sections S1, S2, S3 . . . of the first stacking means 11. Reference numeral 31 denotes a belt for conveying sheets or the like 2, which constitutes one portion of the conveyer passage 7, and the belt 31 moves in a direction indicated by the arrow 32. Reference numeral 18 denotes pulleys for driving the belt 31, and 34 denote rollers for holding the sheets or the like 2 against the belt 31.

Reference numerals 35 denote gate diverters whereby the sheets or the like 2 which have been held between the belt 31 and the rollers 34 and conveyed in the direction of arrow 32 are sorted to the stacking sections S1, S2, S3 . . . . Each of the gate diverters 35 can pivotally move for a predetermined angle around a pivot axis 36. For example, when gate diverters 35*a*, 35*b* extend substantially in parallel to the belt 31, each sheet or the like 2 is passed between the gate diverters 35*a*, 35*b* and the belt 31 and conveyed to a gate diverter 35*c*. Then, the gate diverter 35*c* is pivotally moved for the predetermined angle around a pivot axis 36*c* so that the upper end of the gate diverter 35*c* becomes closer to the associated pulley 18 than the belt 31. In consequence, as shown by a sheet or the like 2', the sheet or the like 2' is passed below the gate diverter 35*c* and introduced into a stacking section 11*c*. By providing as many such structures as the number of stacking sections in the longitudinal direction of the first stacking means 11, the first stacking means 11 can be partitioned into, e.g., 12 stacking sections. Sheets or the like 2" distributed to the stacking sections lean against the partitions 30 between the stacking sections S1 to S12 and are stacked in substantially standing positions, though slightly inclined.

Next, one example of the structure of the feeder means 1, the first stacking means 11, the conveyer means 7, the switch-back portion 8 and the reading means corresponding to the procedures from the feeder means 1 to the first stacking means 11 will be described with reference to FIGS. 4 to 8. FIGS. 4 to 8 are simplified views showing the structures of the preferred embodiments of the sheet or the like sorting apparatus according to the present invention. In these drawings, the conveyer means 7 are expressed by the solid line which only indicates the conveyance course of sheets or the like 2.

Figure 4:
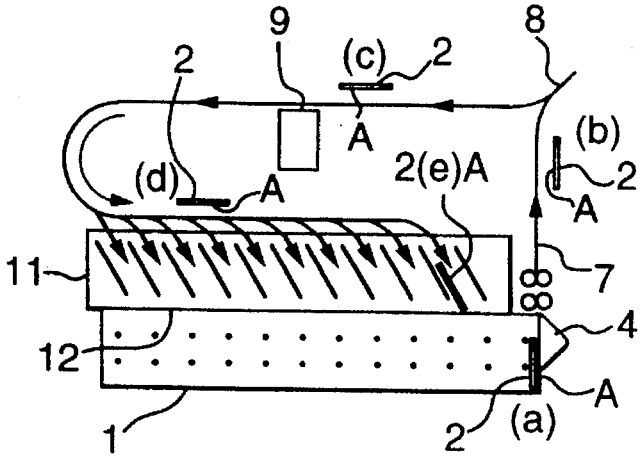
FIG. 4 is a simplified view showing the structure of one embodiment of the sheet or the like sorting apparatus of the invention.

FIG. 4 shows a first embodiment including the switch-back portion 8 and the first address code reading portion 9.

One end of a sheet or the like 2 is blackened to indicate its leading end. The surface of the sheet or the like 2 on which an address code 15 is printed is denoted by reference symbol A and assumed to face the separation means 4. The sheets or the like 2 held in standing positions by the feeder means 1 (state a) are separated and conveyed upwardly one by one by the separation means 4, and then each sheet or the like 2 is passed to the conveyer means 7 (state b). During the conveyance, the sheet or the like 2 enters the switch-back portion, 8 where its direction of conveyance is reversed, and the sheet or the like is passed to the conveyer means 7 from the end which has originally been the trailing end of the sheet or the like 2 (state c). Then, the address code 15 is read by the address code reading means 9. At this time, the surface A faces downwardly, and the address code reading means 9 located below the conveyer means 7 read the address code 15 from the lower side of the sheet or the like 2.

After that, the sheet or the like 2 is conveyed in a state d and stacked in one of the stacking sections of the first stacking means 11 in accordance with the contents of the address code 15 printed on the surface A of the sheet or the like 2, thus completing a series of sorting operations. At this time, the sheet or the like 2 is in a state e which is similar to the state a when the sheet or the like 2 is held in the standing position by the feeder means 1. If the sheet or the like 2 in the first stacking means 11 is shifted to the feeder means 1 and fed to the separation means 4 again, sorting operations of the sheet or the like 2 can be repeated.

Figure 5:
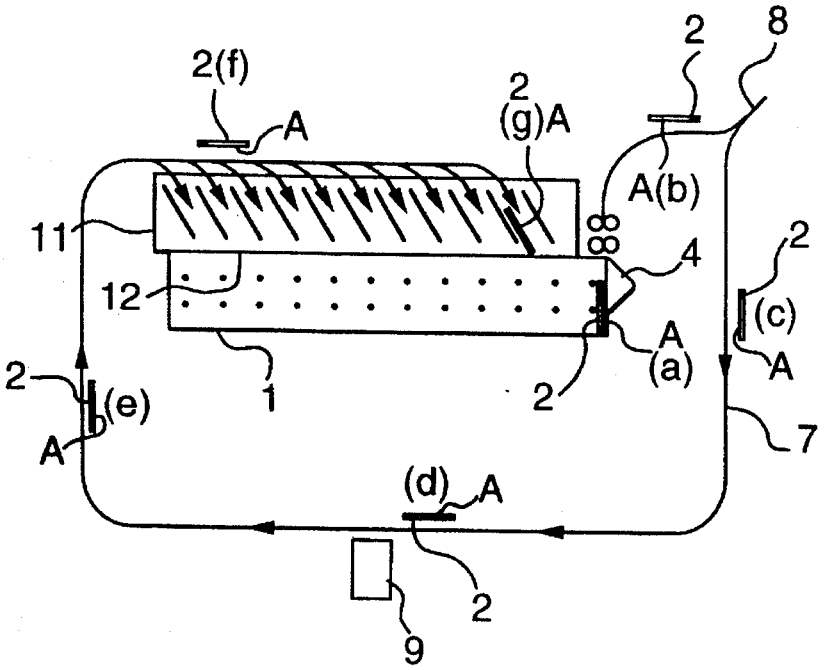
FIG. 5 is a simplified view showing the structure of another embodiment of the sheet or the like sorting apparatus of the invention.

FIG. 5 shows a second embodiment including the switch-back portion 8 and the first address code reading portion 9. This embodiment is different from the first embodiment shown in FIG. 4 in that the conveyer means 7 extend below the feeder means 1. In this case as well, a state a of a sheet or the like 2 when it is held in the standing position by the feeder means 1 is similar to a state g of the sheet or the like 2 which is stacked in one of the collecting sections of the first stacking means 11 after being conveyed in the order of states b to f along the conveyer means 7.

Therefore, if the sheet or the like 2 in the first stacking means 11 is shifted to the feeder means 1 and fed to the separation means 4 again, sorting operations of the sheet or the like 2 can be repeated.

Figure 6:
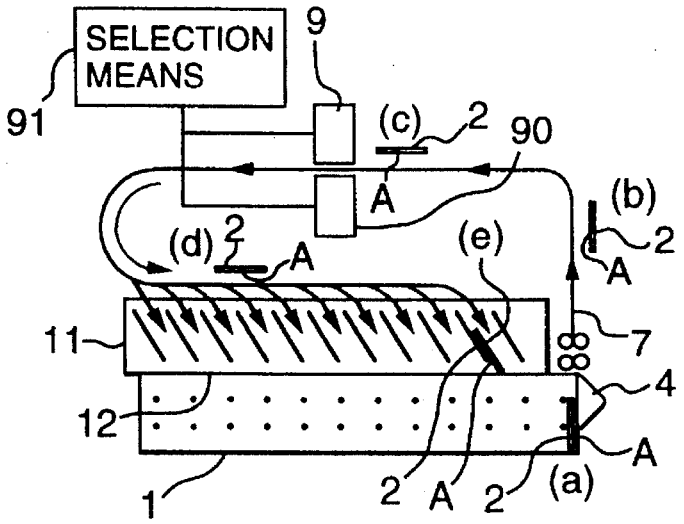
FIG. 6 is a simplified view showing the structure of a further embodiment of the sheet or the like sorting apparatus of the invention.

FIG. 6 shows a third embodiment of the present invention. This embodiment is different from the first embodiment in that it does not include the switch-back portion 8 but includes the first address code reading portion 9 which is provided above the conveyer means 7 so as to read an address code 15 from the upper side of each sheet or the like 2, a second address code reading portion 90 which is provided below the conveyer means 7 so as to read the address code 15 from the lower side of the sheet or the like 2, and selection means 91 for selectively using either the first address code reading portion 9 or the second address code reading portion 90.

The leading end of a sheet or the like 2 and the surface of the sheet or the like 2 on which the address code 15 is printed, are expressed in the same manner as the first embodiment. Sheets or the like 2 held in standing positions by the feeder means 1 (state a) are separated and conveyed upwardly one by one by the separation means 4, and then each sheet or the like 2 is passed to the conveyer means 7 (state b). Then, the address code 15 is read by the address code reading means 9 when the sheet or the like 2 is in a state c. At this time, the surface A faces upwardly, and the first address code reading means 9 read the address code 15. After that, the sheet or the like 2 is conveyed in a state d, and stacked in one of the stacking sections of the first stacking means 11 in accordance with the contents of the address code 15 printed on the surface A of the sheet or the like 2, thus completing a series of sorting operations. At this time, the sheet or the like 2 is in a state e which is reverse to the state a when the sheet or the like 2 is held in the standing position by the feeder means 1, so that the leading and trailing ends and the front and back surfaces of the sheet or the like 2 are reversed.

Consequently, if the sheet or the like 2 in the first stacking means 11 is shifted to the feeder means 1 and fed to the separation means 4 again so as to repeat sorting operations of the sheet or the like 2, the position of the sheet or the like 2 are reversed, and the surface A of the sheet or the like 2 on which the address code 15 is printed faces downwardly, not toward the address code reading means 9. Therefore, the address code 15 is read from the lower side of the sheet or the like 2 by the second address code reading means 90.

With this arrangement, each time a series of sorting operations is repeated, either the first address code reading means 9 or the second address code reading means 90 is selected by the selection means 91 so that sorting operations of the sheet or the like 2 can be repeated.

Figure 7:
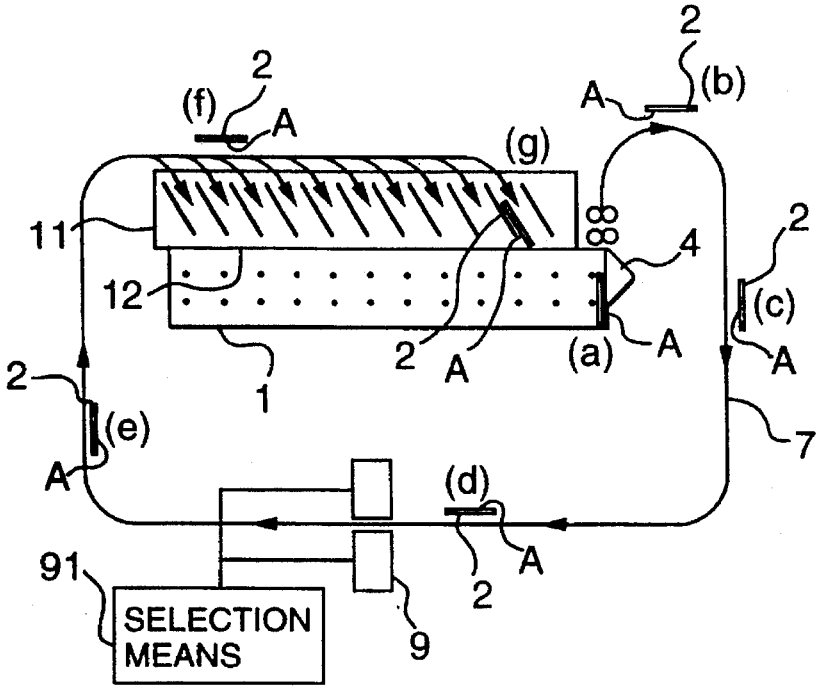
FIG. 7 is a simplified view showing the structure of another embodiment of the sheet or the like sorting apparatus of the invention.

FIG. 7 shows a fourth embodiment of the present invention. This embodiment is different from the third embodiment in that the conveyer means 7 extend below the feeder means 1. In this case as well, a state a of each sheet or the like 2 when it is held in the standing position by the feeder means 1 is reverse to a state g of the sheet or the like 2 which is stacked in one of the stacking sections of the first stacking means 11 after being conveyed in the order of states b to f along the conveyer means 7, so that the leading and trailing ends and the front and back surfaces of the sheet or the like 2 are reversed.

Therefore, each time a series of sorting operations is repeated, either the first address code reading means 9 or the second address code reading means 90 is selected by the selection means 91 so that sorting operations of the sheet or the like 2 can be repeated.

In the embodiments shown in FIGS. 6 and 7, even if the front surfaces of the sheets or the like 2 supplied to the feeder means 1 face different directions, the address codes 15 applied to the sheets or the like 2 can be read by either the first reading means 9 or the second reading means 90. Consequently, when the sheets or the like 2 are supplied to the feeder means 1, the front surfaces of the sheets or the like 2 need not be arranged to face the same direction.

Figure 8:
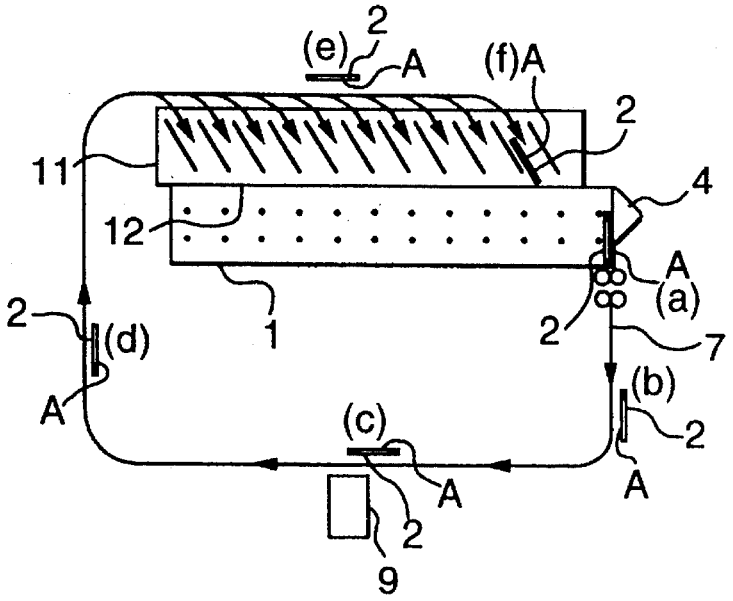
FIG. 8 is a simplified view showing the structure of a further embodiment of the sheet or the like sorting apparatus of the invention.

FIG. 8 shows a fifth embodiment of the invention. This embodiment is different from the first to fourth embodiments in that each sheet or the like 2 separated by the separation means 4 is conveyed downwardly. The fifth embodiment does not include the switch-back portion 8, the second address code reading means 90 and the selection means 91. In the fifth embodiment, a state a of the sheet or the like 2 when it is held in the standing position by the feeder means 1 is similar to a state f of the sheet or the like 2 which is stacked in one of the stacking sections of the first stacking means 11 after conveyed in the order of states b to e along the conveyer means 7.

Therefore, if the sheet or the like 2 in the first stacking means 11 is shifted to the feeder means 1 and fed to the separation means 4 again, sorting operations of the sheet or the like 2 can be repeated.

Next, the process of sequencing operation of sheets or the like 2 (sorting operation in accordance with their carrier route) with the structure of the preferred embodiment of the present invention will be described. FIGS. 9 to 15 are diagrams showing one example of carrier route sequencing operation of sheets or the like 2 in the sheet or the like sorting apparatus according to the invention. The following explanation will be given on the basis of the structure of the first embodiment of the invention shown in FIG. 4. However, the second to fifth embodiments of the invention can be likewise provided although the configuration of the conveyer means 7 from the feeder means 1 to the stacking means 11 and the direction of the front surfaces of the sheets or the like 2 are different.

For the explanation, the contents of address codes 15 are represented by numerals in three digits from 000 to 999, and expressed as COD000 to COD999 to discriminate them from other numerals. This embodiment relates to the operation of sequencing 1000 sheets or the like 2 to which address codes 15 of COD000 to COD999 are applied at random, in accordance with the serial order of the address codes 15 (carrier route sequencing operation). In order to simplify the explanation, the number of sheets or the like 2 is set at a value such that the sheets or the like 2 can be introduced into feeder means 1 at one time, and the sheets or the like 2 distributed to each stacking section of stacking means 11 are assumed not to exceed the capacity of the stacking section. In the following explanation, operations of the component parts will not be described in detail, and orders of the address codes 15 in the process of sequencing of the sheets or the like 2 will only be described.

In FIGS. 9 to 15, conveyer means 7 of the sheets or the like 2 are schematically indicated simply by a solid line or a dashed line for the explanation. When the conveyer means 7 are indicated by a dashed line, it means that the sheets or the like 2 are not present on the conveyer means 7.

The first stacking means 11 are divided into 10 stacking sections corresponding to digits 0 to 9. The conveyed sheets or the like 2 are sorted to the stacking sections in accordance with their address codes 15.

Figure 9:
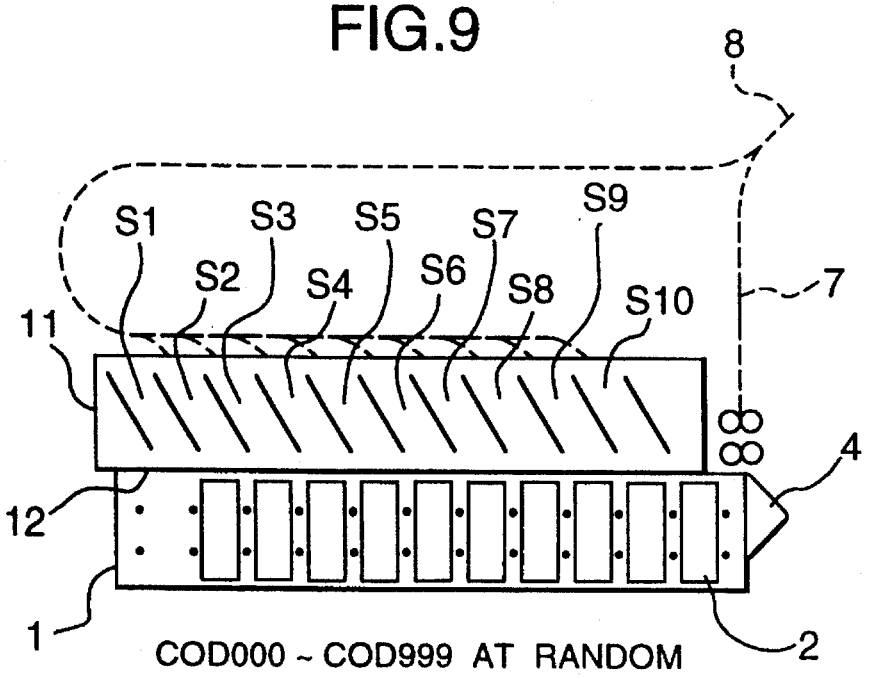
FIG. 9 is a diagram for explaining one example of sequencing operation of sheets or the like in their carrier route order in the sheet or the like sorting apparatus according to the invention.

Referring to FIG. 9, for example, 1000 sheets or the like 2 to which address codes 15 in three digits COD000 to COD999 are applied are provided in the feeder means 1, and the order of the sheets or the like 2 is random. A sheet or the like 2 on the right end abuts against separation means 4. When, for example, a vacuum suction belt 6 of the separation means 4 is rotated, only one sheet or the like 2 on the right end is separated and conveyed upwardly.

The conveyed sheet or the like 2 is fed to first address code reading means 9 which read an address code 15, i.e., one of the numerals COD000 to COD999 in this embodiment, applied to the sheet or the like 2 beforehand.

Figure 10:
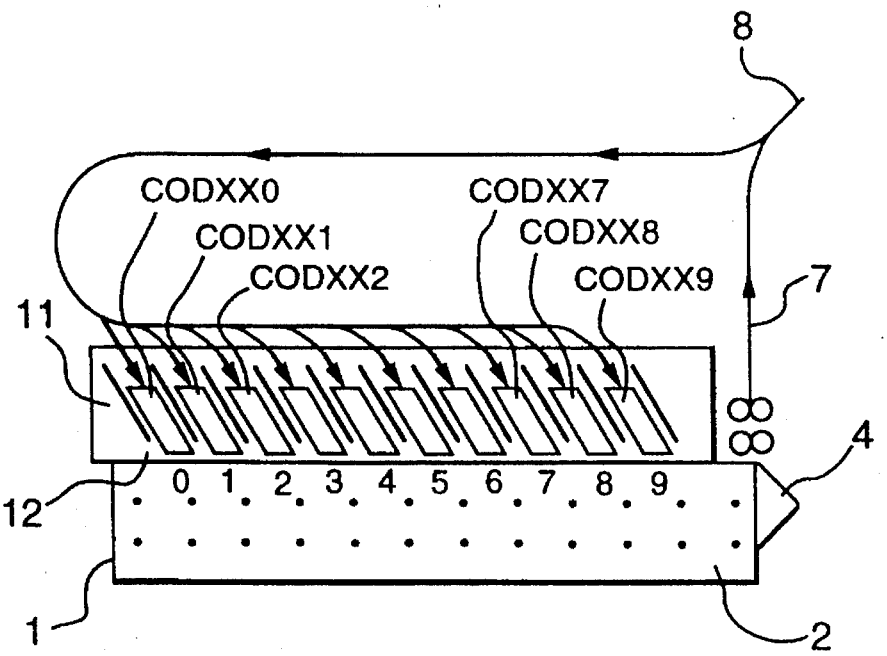
FIG. 10 is a diagram for explaining another example of carrier order sequencing operation in the sheet or the like sorting apparatus according to the invention.

Referring now to FIG. 10, the stacking sections S1 to S10 of the first stacking means 11 are associated with digits 0 to 9 in this order. Each sheet or the like 2 whose address code 15 has been read by the first address code reading means 9 is sorted to one of the stacking sections S1 to S10 corresponding to a digit in the first position from the right, i.e., the units digit, of the address code 15.

When all the sheets or the like 2 are similarly sorted to the stacking sections S1 to S10 corresponding to the units digits of the address codes 15, sheets or the like 2 having the same units digit are stacked in each of the stacking sections S1 to S10. In FIG. 10, an address code CODXX0 indicates that there are stacked sheets or the like 2 whose units digits are all 0 but whose tens and hundreds digits are randomly 0 to 9.

Next, all the sheets or the like 2 are moved into the feeder means 1 without changing the order in which they are stacked in all the stacking sections S1 to S10 of the first stacking means 11.

Figure 11:
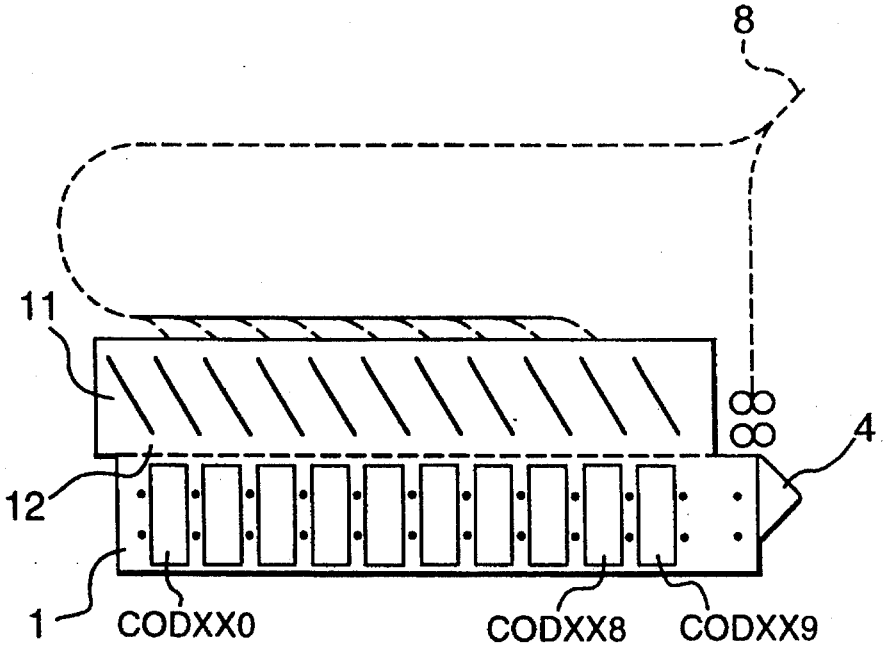
FIG. 11 is a diagram for explaining a further example of carrier order sequencing operation in the sheet or the like sorting apparatus according to the invention.

The state of the sheets or the like 2 after they have been moved is shown in FIG. 11. When the sheets or the like 2 in the feeder means 1 in this state are fed to the separation means 4, only one sheet or the like 2 on the right end can be separated and conveyed upwardly again.

Figure 12:
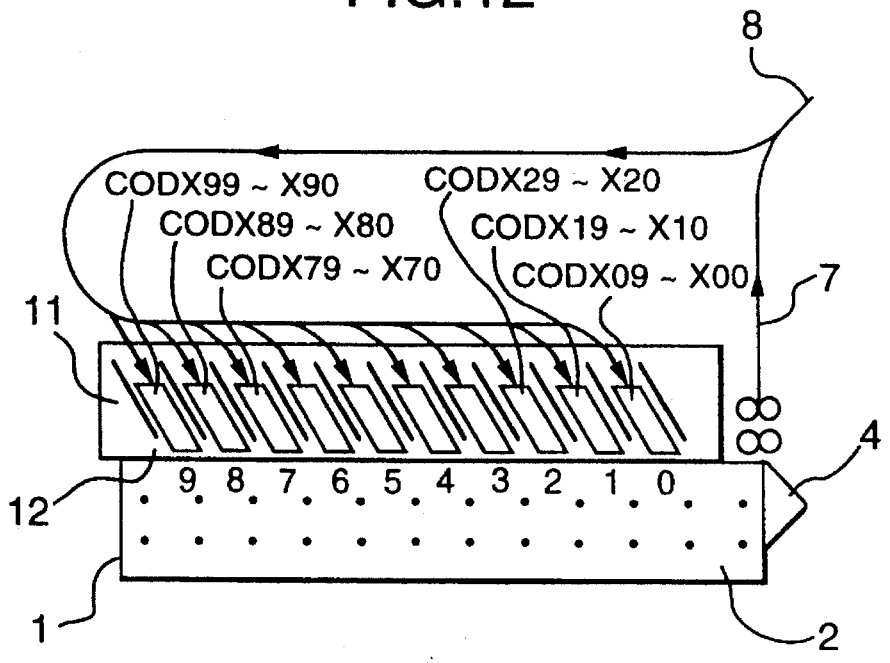
FIG. 12 is a diagram for explaining another example of carrier order sequencing operation in the sheet or the like sorting apparatus according to the invention.

FIG. 12 shows distribution in accordance with digits in the second position from the right, i.e., the tens digits, of the address codes 15. In FIG. 12, the stacking sections S1 to S10 of the first stacking means 11 are associated with digits 9 to 0 in the order reverse to that shown in FIG. 10. As shown in FIG. 11, sheets or the like 2 whose units digits are all 9 are first fed to the separation means 4. Then, each sheet or the like 2 whose address code 15 has been read by the first address code reading means 9 is sorted to one of the stacking sections S1 to S10 corresponding to the tens digit of the address code 15. Similarly, the sheets or the like 2 whose units digits are 8 to 0 are successively sorted to the stacking sections S1 to S10 corresponding to digits in the middle position, i.e., the tens digits of the address codes 15.

As a result, in the stacking section S1, sheets or the like 2 whose hundreds digits are random but whose digits in the right two positions are 99 are stacked on the left end, and sheets or the like 2 whose hundreds digits are random but whose digits in the right two positions are 98 are stacked on the right side of this pile, and further, sheets or the like 2 whose hundreds digits are random but whose digits in the right two positions are 97 are stacked on the right side of the second pile. By repeating this operation, sheets or the like 2 whose hundreds digits are random but whose digits in the right two positions are 90 are eventually stacked on the right end of the stacking section S1. In the stacking section S2, sheets or the like 2 whose hundreds digits are random but whose digits in the right two positions are 89 are stacked on the left end, and sheets or the like 2 whose hundreds digits are random but whose digits in the right two positions are 88 are stacked on the right side of this pile, and further, sheets or the like 2 whose hundreds digits are random but whose digits in the right two positions are 87 are stacked on the right side of the second pile. By repeating this operation, sheets or the like 2 whose hundreds digits are random but whose digits in the right two positions are 80 are eventually stacked on the right end of the stacking section S2. Likewise, in the stacking section S10, sheets or the like 2 whose hundreds digits are random but whose digits in the right two positions are 09 are stacked on the left end, and sheets or the like 2 whose hundreds digits are random but whose digits in the right two positions are 08 are stacked on the right side of this pile, and further, sheets or the like 2 whose hundreds digits are random but whose digits in the right two positions are 07 are stacked on the right side of the second pile. By repeating this operation, sheets or the like 2 whose hundreds digits are random but whose digits in the right two positions are 00 are eventually stacked on the right end of the stacking section S10.

Figure 13:
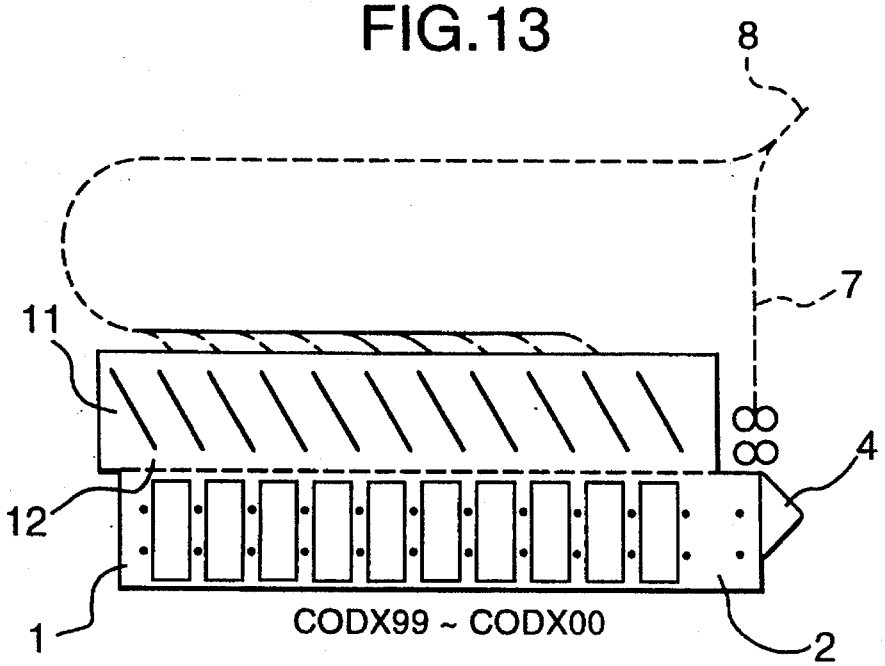
FIG. 13 is a diagram for explaining a further example of carrier order sequencing operation in the sheet or the like sorting apparatus according to the invention.

When the sheets or the like 2 stacked in the stacking means 11 are again moved to the feeder means 1, as shown in FIG. 13, the sheets or the like 2 are located in such an order that the sheets or the like 2 having 00 in the right two positions are on the right end, and that the sheets or the like 2 having 99 in the right two positions are on the left end.

Figure 14:
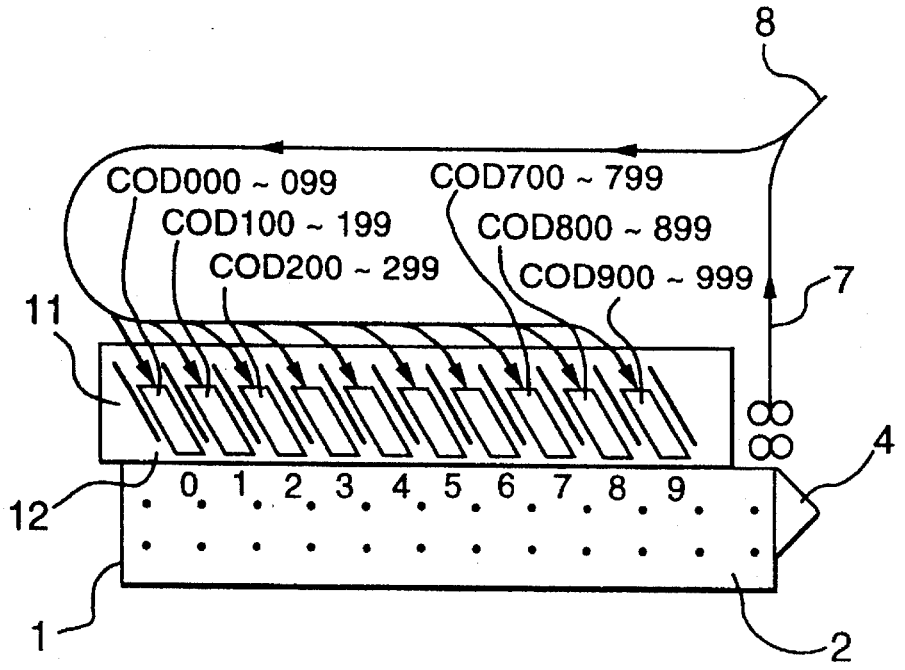
FIG. 14 is a diagram for explaining another example of carrier order sequencing operation in the sheet or the like sorting apparatus according to the invention.
Figure 15:
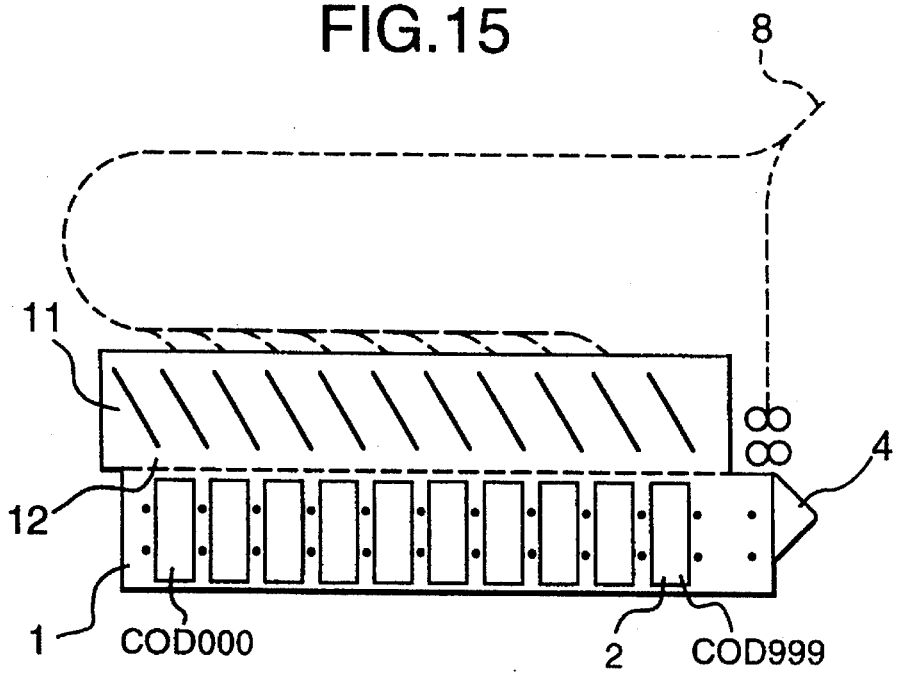
FIG. 15 is a diagram for explaining a further example of carrier order sequencing operation in the sheet or the like sorting apparatus according to the invention.

FIGS. 14 and 15 show distribution in accordance with digits in the third position from the right, i.e., the hundreds digits, of the address codes 15. In FIG. 14, the stacking sections S1 to S10 of the first stacking means 11 are associated with digits 0 to 9 in the order reverse to that shown in FIG. 12. As shown in FIG. 13, sheets or the like 2 all of which have 00 in the right two positions are first fed to the separation means 4. Then, each of the sheets or the like 2 whose address code 15 has been read by the first address code reading means 9 is sorted to one of the stacking sections S1 to S10 corresponding to the hundreds digit of the address code 15. Similarly, sheets or the like 2 which have 01 to 99 in the right two sections are successively sorted to the stacking sections S1 to S10 corresponding to the hundreds digits of the address codes 15.

As a result, in the stacking section S1, a sheet or the like 2 of COD000 is stacked on the left end, and a sheet or the like 2 of COD001 is stacked on the right side of it, and further, a sheet or the like 2 of COD002 is stacked on the right side of the second one. By repeating this operation, a sheet or the like 2 of COD099 is eventually stacked on the right end of the stacking section S1. In the stacking section S2, a sheet or the like 2 of COD100 is stacked on the left end, and a sheet or the like 2 of COD101 is stacked on the right side of it, and further, a sheet or the like 2 of COD102 is stacked on the right side of the second one. By repeating this operation, a sheet or the like 2 of COD199 is eventually stacked on the right end of the stacking section S2. Likewise, in the stacking section S10, a sheet or the like 2 of COD900 is stacked on the left end, and a sheet or the like 2 of COD901 is stacked on the right side of it, and further, a sheet or the like 2 of COD902 is stacked on the right side of the second one. By repeating this operation, a sheet or the like 2 of COD999 is eventually stacked on the right end of the stacking section S10.

As a result of the foregoing operations, all the sheets or the like 2 are sequenced in the serial order of the address codes 15 displayed on the sheets or the like 2, from the sheet or the like 2 of COD000 stacked on the left end of the stacking means 11, to the sheet or the like 2 of COD999 stacked on the right end of the stacking means 11.

In this embodiment, the sheets or the like 2 are sequenced in such a manner that the left-end one is COD000 and the right-end one is COD999. However, if the orders of digits corresponding to the stacking sections S1 to S10 in FIGS. 10, 12 and 14 are all reversed, the sheets or the like 2 can be sequenced in such a manner that the right-end one is COD000 and the left-end one is COD999.

Moreover, in this embodiment, 1000 codes from COD000 to COD999 are sequenced by repeating sorting to 10 stacking sections three times. However, the present invention is not limited to this embodiment. When the number of stacking sections is U and the number of repetition of sorting operations is n, it is possible to sequence $U^n$ codes.

The process of sequencing of the sheets or the like 2 in the serial order of the address codes 15 displayed on the sheets or the like 2 has been described above. In this embodiment, the number of the sheets or the like 2 does not exceed the capacity of the feeder means 1 and the capacity of the stacking means 11, and also, the number of the sheets or the like 2 in each of the stacking sections S1 to S10 does not exceed the capacity of the stacking section.

Means for sequencing sheets or the like 2 when the number of the sheets or the like 2 exceeds the capacity of the feeder means 1 will now be described.

Figure 16:
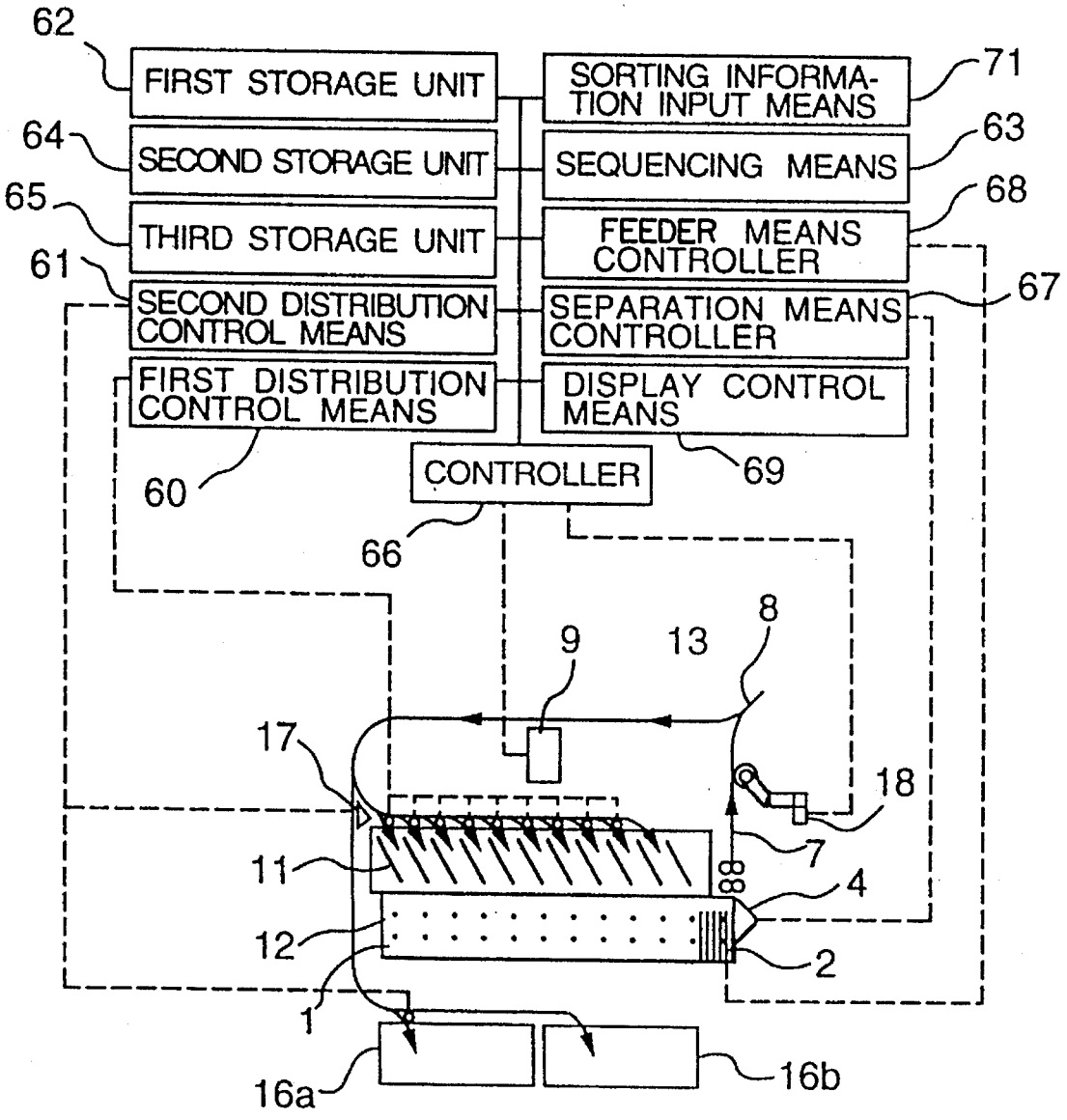
FIG. 16 is a block diagram showing the structure of one embodiment of a sheet or the like sorting apparatus according to the present invention.

FIG. 16 is a block diagram showing the structure of one embodiment of a sheets or the like sorting apparatus according to the present invention. In this embodiment, first stacking means 11 which are partitioned into 12 stacking sections are employed as one example.

In FIG. 16, reference numerals 16 denote second stacking means in which sheets or the like 2 can be stacked, 17 denotes second distributing means for distributing the sheets or the like 2 to the second stacking means 16, 18 denotes thickness detecting means which can detect the thickness of each sheet or the like 2, 60 denotes first distribution control means which can control the first distributing means 13, 61 denotes second distribution control means which can control the second distributing means 17, 62 denotes a first storage unit in which address codes 15 read by the address code reading means 9 and thickness of the sheets or the like 2 determined by the thickness detecting means 18 can be stored, 63 denotes sequencing means for sequencing the address codes and the thickness in the serial order of the address codes 15, 64 denotes a second storage unit in which the address codes and the thickness sequenced by the sequencing means 63 are stored and also processing segment information for dividing all the sheets or the like 2 into a plurality of processing segments for distributing them is stored, and 65 denotes a third storage unit in which the correspondence between digits in each position of the address codes to be distributed and the stacking sections of the first stacking means 11 is stored.

Reference numeral 67 denotes a separation means controller which can control the separation means 4, 68 denotes a feeder means controller which can control the feeder means 1, 69 denotes display control means which display predetermined information on the display means 14, and 71 denotes sorting information input means in which sorting information of the sheets or the like 2 in accordance with their carrier route can be inputted.

Reference numeral 66 denotes a controller which can control the thickness detecting means 18, the address code reading means 9, the first storage unit 62, the second storage unit 64, the third storage unit 65, the sequencing means 63, the first distribution control means 60, the second distribution control means 61, the separation means controller 67, the feeder means controller 68, the display control means 69 and the sorting information input means 71.

Flow charts of FIGS. 17 to 20 and Tables 1 to 4 show the operation of the sheets or the like sorting apparatus according to this embodiment the present invention.

Figure 17:
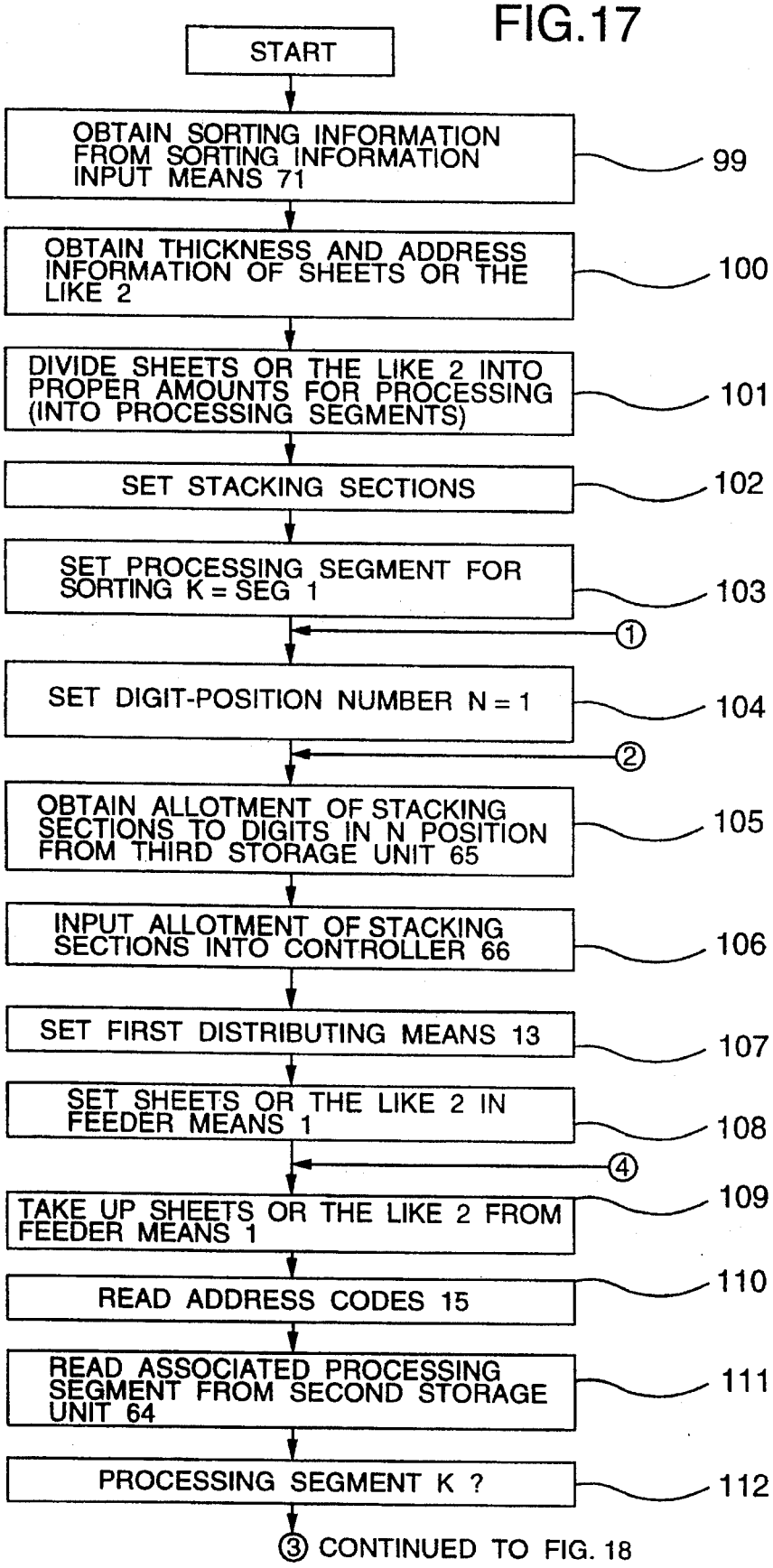
FIGS. 17 and 18 provide a flow chart showing operation procedures of the embodiment of the sheet or the like sorting apparatus according to the invention.
Figure 18:
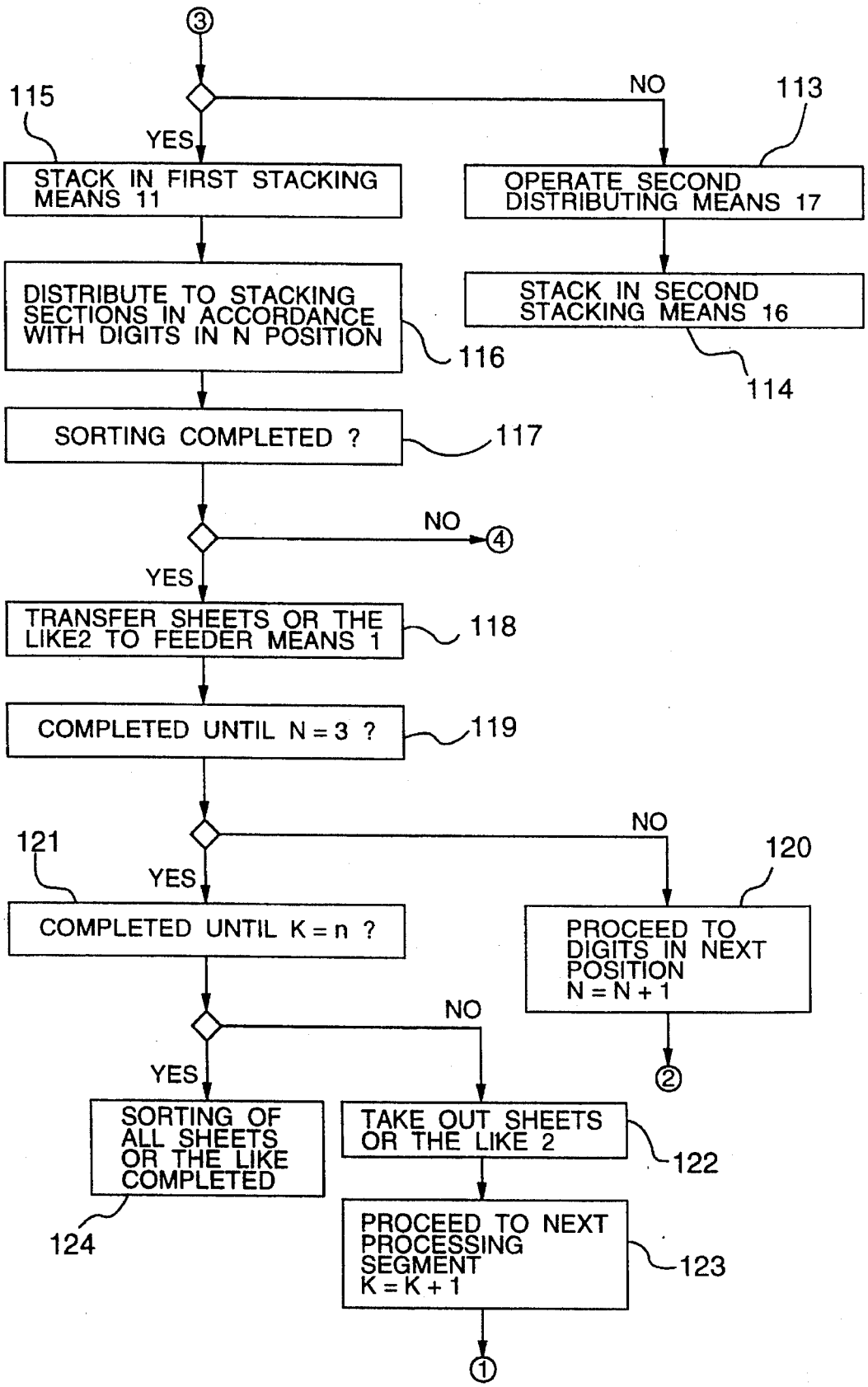

Referring to FIG. 17, sorting information of address codes 15 applied to the sheets or the like 2 to be processed, which indicates the carrier route, is obtained from the sorting information input means 71 (step 99).

Next, the thickness and address codes 15 of all the sheets or the like 2 are obtained (step 100). This operation will be described with reference to FIG. 19.

Figure 19:
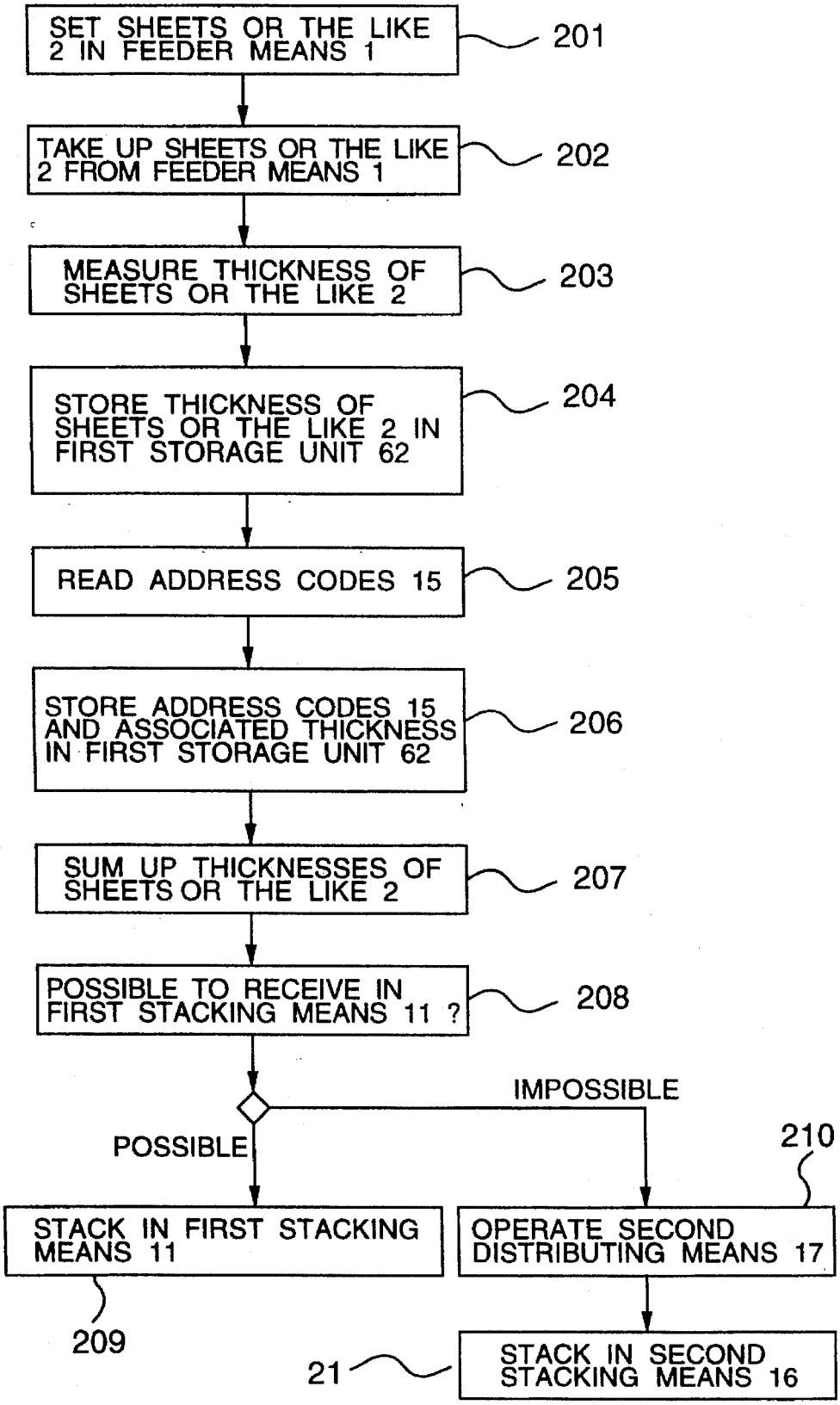
FIG. 19 is a flow chart showing operation procedures of the embodiment of the sheet or the like sorting apparatus according to the invention.

FIG. 19 is a flow chart showing operation of the means 18 for obtaining the thickness and the means 9 for obtaining the address codes 15 of the sheets or the like 2.

Referring to FIG. 19, when the sheets or the like 2 are supplied to the feeder means 1 (step 201), the controller 66 transmits signals to the feeder means controller 68 and the separation means controller 67 so that the feeder means 1 move the sheets or the like 2 toward the separation means 4, and so that the separation means 4 take up the sheets or the like 2 one by one from the right end and pass them to the conveyer passage 7 (step 202). The thickness of the sheet or the like 2 is determined by the thickness detecting means 18 (step 203), which thickness is stored in the first storage unit 62 (step 204). The sheet or the like 2 is conveyed via the switch-back portion 8 to the address code reading means 9 in which the address code 15 which was applied to the sheet or the like 2 beforehand is read (step 205), and the address code 15 is inputted in the first storage unit 62 (step 206). In this manner, the address code 15 and the thickness of each of the sheets or the like 2 are stored in the first storage unit 62.

Table 1 shows one example of stored information in the first storage unit 62. In this table, entry numbers are numerals which are applied, for convenience's sake, to the sheets or the like 2 in order when they are fed. As shown in Table 1, the address code 15 and the thickness of each of the sheets or the like 2 are stored in an associated manner in the first storage unit 62.

TABLE 1

CONTENTS OF FIRST STORAGE UNIT

| ENTRY NUMBER | ADDRESS CODE | THICKNESS |
|---|---|---|
| 000 | COD981 | 2 |
| 001 | COD454 | 1 |
| 002 | COD214 | 1 |
| 003 | COD637 | 3 |
| 004 | COD020 | 1 |
| . | . | . |
| . | . | . |
| . | . | . |
| 998 | COD234 | 1 |
| 999 | COD522 | 5 |

When each of the sheets or the like 2 is fed, the thickness of the sheets or the like 2 is summed up (step 207), and if the total of the thickness of the fed sheets or the like 2 is smaller than the capacity of the first stacking means 11, it is determined that the sheets or the like 2 can be collected in the first stacking means 11 (208). In this case, the sheets or the like 2 are stacked in the first stacking means 11 (209). If it is determined that the sheets or the like 2 can not be stacked, the second distribution control means 61 are controlled (step 210) to collect the sheets or the like 2 in the second sorting means 16 (step 211).

When the total amount of the sheets or the like 2 exceeds an amount which can be supplied to the feeder means 1 at one time, the sheets or the like 2 must be divided and processed. In this embodiment, the sheets or the like 2 are divided into some segments each of which has an amount which can be sorted at once, and each of these segments will be referred to as a processing segment (step 101, FIG. 17).

Figure 20:
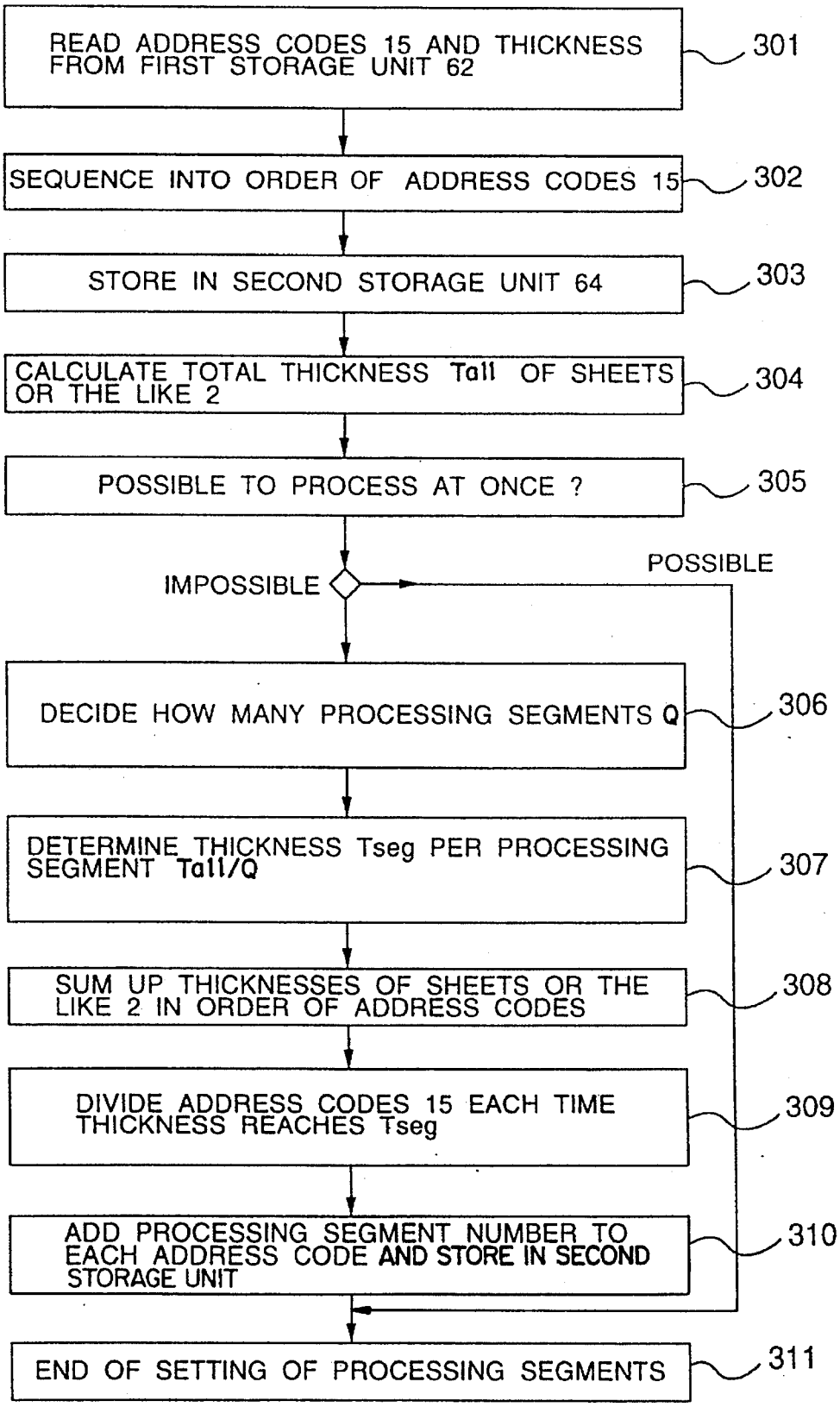
FIG. 20 is a flow chart showing operation procedures of the embodiment of the sheet or the like sorting apparatus according to the invention.

FIG. 20 shows one embodiment for setting processing segments.

Referring to FIG. 20, the address codes 15 and thickness of the sheets or the like 2 are read from the first storage unit 62 (step 301), sequenced in the serial order of the address codes 15 by the sequencing means 63 (step 302), and stored in the second storage unit 64 (step 303). Table 2 shows one example of the contents in the second storage unit 64 at this time. In this example, the address codes 15 are stored in a first column 320, and the thicknesses are stored in a second column 321.

TABLE 2

CONTENTS OF SECOND STORAGE UNIT

| ADDRESS CODE | THICKNESS t | PROCESSING SEGMENT | TOTAL THICKNESS |
|---|---|---|---|
| COD000 | 1 | SEG1 | Σt < Tseg |
| COD001 | 2 | SEG1 | |
| COD002 | 1 | SEG1 | |
| . | . | . | |
| . | . | . | |
| . | . | . | |
| COD299 | 4 | SEG1 | |
| COD300 | 2 | SEG2 | Σt < Tseg |
| COD301 | 1 | SEG2 | |
| . | . | . | |
| . | . | . | |
| . | . | . | |
| COD649 | 2 | SEG2 | |
| COD650 | 1 | SEG3 | Σt < Tseg |
| COD651 | 2 | SEG3 | |
| . | . | . | |
| . | . | . | |
| . | . | . | |
| COD998 | 4 | SEG3 | |
| COD999 | 1 | SEG3 | |
| 320 | 321 | 322 | |

Next, the thicknesses of all the sheets or the like 2 are added up in the serial order from the top of the address codes 15 stored in the second storage unit 64, to thereby derive the total thickness Tall of the sheets or the like 2 (step 304). Then, the total thickness Tall is compared with a thickness R of sheets or the like which can be supplied to the feeder means 1 at one time (step 305). When Tall <R, all the sheets or the like 2 can be processed at once. Otherwise, the sheets or the like 2 must be divided into some processing segments, First, the total thickness of sheets or the like 2 which can be supplied to the feeder means 1 at once is expressed as R, and Tall/R is calculated. By raising the decimals of the resultant value to a unit, an integer value Q is obtained. Thus, the value Q can be determined as the number of divisions of the sheets or the like 2, i.e., the number of processing segments (step 306). That is to say, the sheets or the like 2 are divided into Q processing segments each having a thickness Tseg=Tall/Q (step 307). Because Tseg<R, each processing segment can be supplied to the feeder means 1 at once. In this embodiment, an explanation will be given on the case where Q=3.

When, the thicknesses of the sheets or the like 2 are summed up in the serial order of the address codes 15 from COD000 (step 308) and expressed as Σt, a range of the address codes 15 in a range Σt<Tseg is derived. For example, if the sum of thicknesses of the sheets or the like 2 from COD000 to COD299 is smaller than the processing segment thickness Tseg, and if the sum of thicknesses of the sheets or the like 2 from COD000 to COD300 is larger than Tseg, the sheets or the like 2 from COD000 to COD299 can be regarded as one processing segment (step 309). This is referred to as a first processing segment SEG1, and this reference numeral is additionally applied to each of the address codes 15. The resultant codes are stored in the second storage unit 64 (step 310). Processing segments of the sheets or the like 2 of COD300 and the following codes can be set each time the sum of thickness reaches the processing segment thickness Tseg, to thereby complete setting of the processing segments (step 311). Table 2 shows one example of the contents of the second storage unit 64 when the processing segments are set. More specifically, the thickness and the processing segment numerals SEG1 to SEG3 of the sheets or the like 2 are added to the address codes 15 in the serial order, and the address codes COD300 to COD649 are regarded as a second processing segment SEG2, the address codes COD650 to COD999 being regarded as a third processing segment SEG3. Sets of the sheets or the like 2 belonging to the three processing segments have a substantially uniform total thickness Σt.

Each of the sets of the sheets or the like 2 belonging to the first to third processing segments SEG1 to SEG3 has an number of sheets or the like which can be supplied to the feeder means 1 at one time. However, if the number of sheets or the like 2 corresponding to some of the address codes 15 is large, or if a large number of thick sheets or the like 2 are processed, the sheets or the like 2 overflow the stacking section in question. In order to avoid such a situation, a stacking section where overflowing of sheets or the like 2 may occur is predicted, and a plurality of continuous stacking sections are allotted in place of the stacking section in question, thus preventing the occurrence of overflowing (step 102, FIG. 17).

Figure 21:
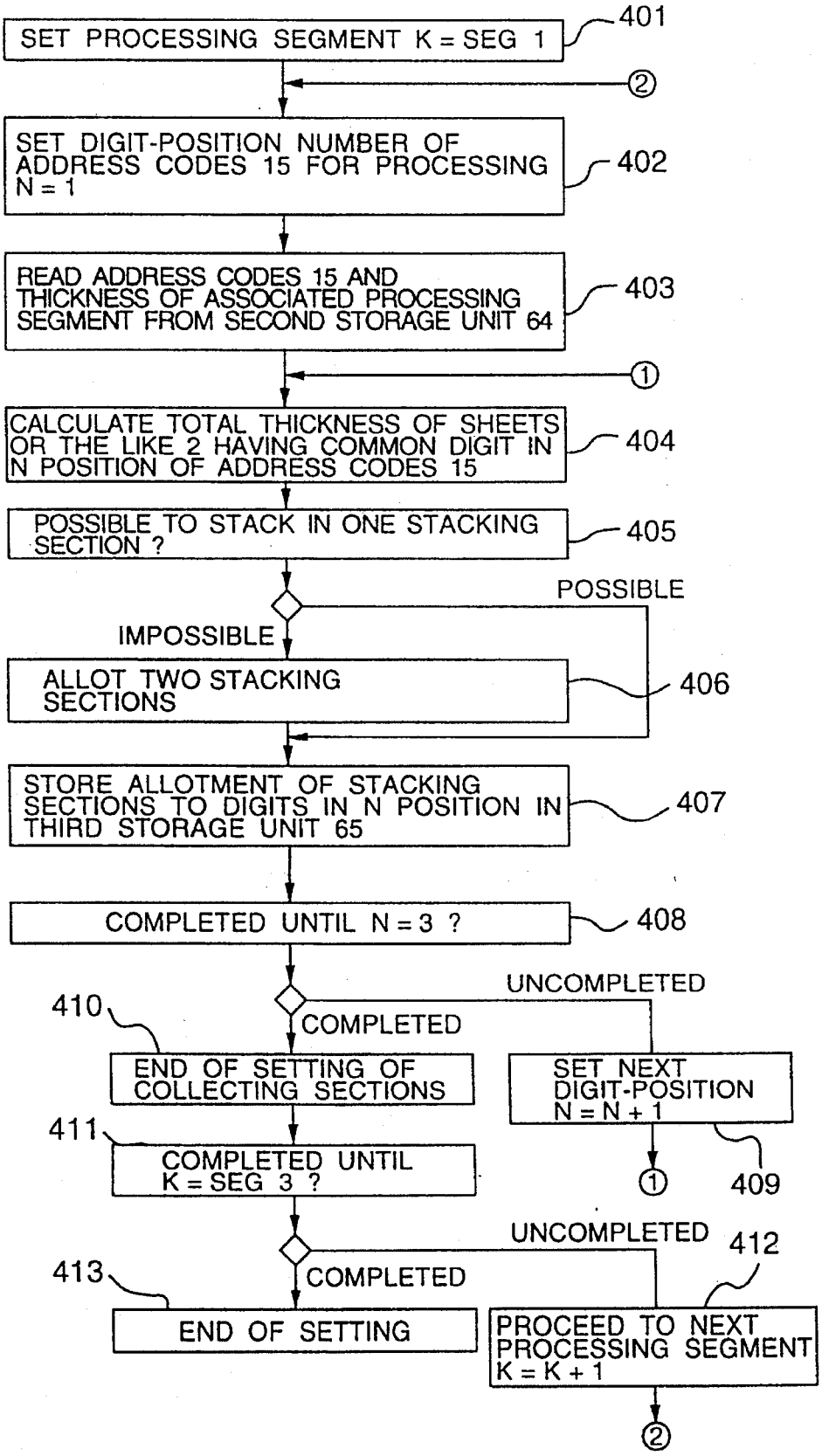
FIG. 21 is a flow chart showing operation procedures of the embodiment of the sheet or the like sorting apparatus according to the invention.

A process for setting stacking sections will now be described with reference to FIG. 21. FIG. 21 is a flow chart showing the process for setting stacking sections. As has been described in the explanation of the carrier route sequencing operation with reference to FIGS. 9 to 15, sheets or the like 2 whose address codes 15 have a common digit in each position are stacked in one stacking section every time the sorting operation is performed. Therefore, thickness of sheets or the like 2 stacked in one stacking section corresponding to a digit in each position of the codes is calculated in advance, to thereby predict the occurrence of overflowing of the sheets or the like 2.

The sorting operation starts from digits in the first position from the right of address codes of the first processing segment SEG1. One example of this operation will be described with reference to FIG. 21 and Tables 3 and 4.

TABLE 3

EXAMPLE OF DISTRIBUTING FIRST-POSITION DIGITS OF ADDRESS CODES IN FIRST PROCESSING SEGMENT

| | a | | b | | | j | |
|---|---|---|---|---|---|---|---|
| | ADDRESS CODE | THICKNESS | ADDRESS CODE | THICKNESS | ... | ADDRESS CODE | THICKNESS |
| | COD180 | 5 | COD211 | 2 | ... | COD159 | 1 |
| | COD070 | 1 | COD051 | 3 | ... | COD049 | 2 |
| | COD150 | 1 | COD091 | 2 | ... | COD239 | 1 |
| | COD290 | 2 | COD171 | 1 | ... | COD029 | 1 |
| | . | . | . | . | ... | . | . |
| | . | . | . | . | ... | . | . |
| | . | . | . | . | ... | COD119 | 4 |
| | COD020 | 4 | COD241 | 2 | ... | | |
| | | | COD121 | 1 | ... | | |
| TOTAL THICKNESS | ΣCODxx0 | 65 (<s) | ΣCODxx1 | 152 (>s) | ... | ΣCODxx9 | 85 (<s) |
| NUMBER OF STACKING SECTIONS | | 1 | | 2 | ... | | 1 |

s = 120

TABLE 4

EXAMPLE OF CONTENTS OF THIRD STORAGE UNIT

| PROCESSING SEGMENT DISTRIBUTING | | FIRST PROCESSING SEGMENT SEG1 | | | SECOND PROCESSING SEGMENT SEG2 | | | THIRD PROCESSING SEGMENT SEG3 | | |
|---|---|---|---|---|---|---|---|---|---|---|
| DIGIT POSITION | | THIRD POSITION | SECOND POSITION | FIRST POSITION | THIRD POSITION | SECOND POSITION | FIRST POSITION | THIRD POSITION | SECOND POSITION | FIRST POSITION |
| STACKING SECTION | S1 | 0 | 9 | 0 | 3 | 9 | 0 | 6 | 9 | 0 |
| | S2 | 0 | 8 | 1 | 3 | 8 | 1 | 6 | 9 | 0 |
| | S3 | 0 | 7 | 1 | 3 | 7 | 2 | 7 | 8 | 1 |
| | S4 | 1 | 7 | 2 | 4 | 6 | 2 | 7 | 7 | 2 |
| | S5 | 1 | 6 | 3 | 4 | 5 | 3 | 7 | 6 | 3 |
| | S6 | 1 | 5 | 4 | 4 | 4 | 4 | 8 | 5 | 4 |
| | S7 | 1 | 4 | 5 | 4 | 3 | 5 | 8 | 4 | 4 |
| | S8 | 2 | 3 | 5 | 5 | 2 | 6 | 8 | 3 | 5 |
| | S9 | 2 | 3 | 6 | 5 | 1 | 6 | 9 | 2 | 6 |
| | S10 | 2 | 2 | 7 | 5 | 0 | 7 | 9 | 1 | 7 |

TABLE 4-continued

| PROCESSING SEGMENT DISTRIBUTING | EXAMPLE OF CONTENTS OF THIRD STORAGE UNIT | | | | | | | | |
|---|---|---|---|---|---|---|---|---|---|
| | FIRST PROCESSING SEGMENT SEG1 | | | SECOND PROCESSING SEGMENT SEG2 | | | THIRD PROCESSING SEGMENT SEG3 | | |
| DIGIT POSITION | THIRD POSITION | SECOND POSITION | FIRST POSITION | THIRD POSITION | SECOND POSITION | FIRST POSITION | THIRD POSITION | SECOND POSITION | FIRST POSITION |
| S11 | 2 | 1 | 8 | 6 | — | 8 | 9 | 1 | 8 |
| S12 | 2 | 0 | 9 | 6 | — | 9 | 9 | 0 | 9 |
| | a | b | c | d | e | f | g | h | i |

First, a processing segment is determined, and in this example, the first processing segment SEG1 is selected (step 401). Then, a digit position number N of address codes is set. In this example, the operation starts from a digit in the first position from the right of the address codes, and consequently, N=1 (step 402). Next, address codes 15 of the sheets or the like 2 belonging to the first processing segment SEG1, i.e., COD000 to COD299, and thicknesses of the sheets or the like 2 corresponding to the respective address codes 15 are read from the second storage unit (step 403). After that, groups of address codes 15 which have common digits in the first position are collected (step 404). More specifically, as shown in Table 3, for example, address codes 15 having 0 in the first position and the associated thicknesses are only collected in a column a, and address codes 15 having 1 in the first position and the associated thicknesses are only collected in a column b, and then, this operation is likewise repeated with address codes 15 having 2 to 9 in the first position.

Next, the thicknesses of sets of the sheets or the like 2 which have been stacked in accordance with the respective digits in the first position of the address codes 15 are summed up (step 404). When x expresses an arbitrary digit, the total thickness of the sheets or the like 2 having 0 in the first position of the address codes is expressed as ΣCODxx0, and the thickness of the sheets or the like 2 which can be stacked in one stacking section is expressed as s. For example, the thickness s is 120 mm. If ΣCODxx0 is 65 mm, for example, these sheets or the like 2 can be stacked in one stacking section because ΣCODxx0<s. If ΣCODxx1 is 152 mm, for example, these sheets or the like 2 can not be stacked in one stacking section because ΣCODxx1>s (step 405). Consequently, it is judged that two stacking sections are allotted to the sheets or the like 2 having 1 in the first position of the address codes (step 406).

Thereafter, such an operation is repeated for the sheets or the like 2 having 2 to 9 in the first position of the address codes. Two stacking sections are allotted to each of the sets of the sheets or the like 2 having, for example, 1 and 5, in the first position of the address codes, and one stacking section is allotted to each of the other sets of the sheets or the like 2.

As for the digits in the first position of the codes in the first processing segment, when 12 stacking sections are referred to as S1 to S12, the digit 0 is allotted to a stacking section S1, and the digit 1 is allotted to stacking sections S2 and S3. When the digits 2 to 9 in the first position are likewise allotted to the other stacking sections in this order, as shown in a column c of Table 4, the digits in the first position of the address codes are allotted to all the stacking sections S1 to S12, and this allotment is stored in the third storage unit 65 (step 407).

Thus, the allotment of the digits in the first position of the address codes in the first processing segment SEG1 is completed. It is judged whether the allotment of the digits up to N=3 is completed or not (step 408). If not, the digit position number is set as N=N+1=2 (step 409), and the digits in the second position from the right of the address codes are allotted to the stacking sections S1 to S12. However, as has been described with reference to FIGS. 9 to 15, the order of the digits corresponding to the stacking sections must be reversed each time the digit position number of the address codes is changed, and consequently, in the second position of the address codes, the digit 9 is allotted to the stacking section S1 and the digit 0 to the stacking section S12. A column b of Table 4 shows one example in which two continuous stacking sections are allotted to each of sets of sheets or the like 2 having 3 and 7 in the second position of the address codes 15 of the first processing segment SEG1. Since only the sheets or the like 2 from COD000 to COD299 belong to the first processing segment SEG1, the digits 0 to 2 in the third position from the right of the address codes are allotted to the stacking sections in this order. Because the order of the digits must be made reverse to that of the digits in the second position, the digit 0 is allotted to the stacking section S1 and the digit 2 to the stacking section S12.

When the digit allotment of the third position is completed (step 410), it is judged whether setting of the third processing segment SEG3 is completed or not (step 411). If not, the processing segment number is set as K=K+1 =SEG2 (step 412), and stacking sections for the second processing segment SEG2 are determined, and similar operation is repeated for the third processing segment SEG3. Then, as shown in columns d to i of Table 4, all the stacking sections for all the processing segments are determined for the digits in the respective positions of the address codes (step 413). If overflowing of sheets or the like 2 occurs in none of the stacking sections, only the stacking sections S1 to S10 are used, as shown in column e of Table 4, and the other stacking sections need not be used.

Thus, allotments of all the stacking sections S1 to S12 in all the processing segments SEG1 to SEG3 corresponding to the digits in the respective positions of the address codes are stored in the third storage unit 65, to thereby complete setting of the stacking sections.

Next, in order to start processing from the first processing segment SEG1, the processing segment number K=SEG1 is set (step 103).

First, in order to sort the sheets or the like 2 in accordance with the digits in the first position from the right of the address codes 15 in a manner shown in FIGS. 9 and 10, the digit position number N=1 is set (step 104). Then, the allotment of stacking sections to the digits in the first position of the address codes in the first processing segment SEG1 (according to the column c of Table 4) is obtained from the third storage unit 65 (step 105), and it is inputted to the controller 66 (step 106). In response to the allotment setting, the controller 66 sends a command to the first distribution control unit 60 and controls the gate diverters 35*a* to 35*j* (step 107).

When the sheets or the like 2 are supplied again to the feeder means 1 (step 108), the controller 66 transmits signals to the feeder means controller 68 and the separation means controller 67, so that the feeder means 1 move the sheets or the like 2 toward the separation means 4, and so that the separation means 4 take up the sheets or the like 2 one by one from the right end and pass them to the conveyer passage 7 (step 109).

An address code of the sheet or the like 2 is read by the address code reading means 9 (step 110). The read address code is checked with the contents of the second storage unit 64 (step 111), and it is judged which of the first to third processing segments SEG1 to SEG3 the sheet or the like 2 belongs to (step 112). If the sheet or the like 2 belongs to the second or third processing segment SEG2 or SEG3, the controller 66 sends a command to the second distribution control unit 60 so as to actuate the second distributing means 17 (step 113), and the sheet or the like 2 is stacked in the second stacking means 16 (step 114).

If the sheet or the like 2 belongs to the first processing segment SEG1, it is stacked in the first stacking means 11 (step 115). In accordance with a digit in the first position from the right of the address code, the first distribution control unit 61 sends a command for actuating the associated gate diverters 35*a* to 35*j*. For example, if the address code is COD180, it is checked with the contents of the second storage unit 64, and consequently, it is found out that the address code belongs to the first processing segment SEG1. Further, when the address code is checked with the contents of the third storage unit 65, it is judged that the address code indicates a sheet or the like 2 to be stacked in the stacking section S1. Then, the controller 66 sends a command for actuating the gate diverter 35*a*, to the first distribution control unit 60, and the sheet or the like 2 of the address code COD180 is stacked in the stacking section S1 of the first stacking means 11 (step 116).

It is judged whether all the sheets or the like 2 are stacked in the first stacking means 11 or the second stacking means 16 (step 117). If not, feeding of the sheets or the like 2 is continued. After the completion, only the sheets or the like 2 belonging to the first processing segment SEG1 are stacked in the first stacking means 11 in a sorted state in accordance with the digits in the first position of the address codes on the basis of the allotment of the stacking sections which is stored in the third storage unit 65, as shown in the column c of Table 4.

Next, the sheets or the like 2 stacked in the first stacking means 11 are shifted to the feeder means 1 without changing the order of the sheets or the like 2 (step 118). At this time, because the first stacking means 11 are located above the feeder means 1, the sheets or the like 2 sorted and stacked in the stacking sections S1 to S12 of the first stacking means 11 are merely moved to the feeder means 1 located below. Therefore, the sheets or the like 2 need not be shifted into a tray or the like temporarily and moved to the vicinity of the feeder means 1. The sheets or the like 2 can be easily supplied to the feeder means 1 again.

With the above-described procedures, sorting in accordance with the digits in the first position of the address codes is completed. Next, it is judged whether sorting until the third position of the address codes is completed or not (step 119). If not, the digit position number is set as N=N+1=2, and sorting is conducted in accordance with the digits in the second position of the address codes (step 120). When starting the second-position distribution, the allotment of the stacking sections shown in the column b of Table 4 is obtained from the third storage unit 65 (step 105). Thereafter, similar operation is repeated to repeat sorting through the third position of the address codes. In consequence, in the same manner as has been described with reference to FIGS. 9 to 15, the sheets or the like 2 of the first processing segment SEG1 can be sequenced in the serial order of the address codes COD000 to COD299.

Next, it is judged whether processing of all the processing segments SEG1 to SEG3 is completed or not (step 121). When processing of the sheets or the like 2 belonging to only the first processing segment SEG1 is finished, all the sheets or the like 2 are removed from the first stacking means 11 (step 122), and the next processing segment K=K+1=SEG2 is set (step 123), and then, sheets or the like 2 belonging to the second processing segment SEG2 are provided in the feeder means 1 (step 108), to thereby start processing them. At this time, the sheets or the like 2 belonging to the second processing segment SEG2 and sheets or the like 2 belonging to the third processing segment SEG3 are stacked in the second stacking means 16, so that the sheets or the like 2 belonging to the second processing segment SEG2 must be removed from the second stacking means 16 and supplied to the feeder means 1.

If the second stacking means 16 are divided into, for example, two sections a and b, the sheets or the like 2 belonging to the second processing segment SEG2 can be stacked in the section a, and the sheets or the like 2 belonging to the third processing segment SEG3 can be stacked in the section b. With such a structure, sheets or the like 2 can be stacked in the second stacking means 16 in a sorted state in accordance with the processing segments.

When sequencing of the sheets or the like 2 in all the processing segments is completed (step 124), the sheets or the like 2 from the first processing segment SEG1 to the third processing segment SEG3 are sequenced to carrier route of the respective processing segments. When the sheets or the like 2 are placed in the order of the processing segments SEG1 to SEG3, all the sheets or the like 2 are placed in the serial order of the address codes COD000 to COD999, thus completing carrier route sequencing of all the sheets or the like 2.

With the above-described structure, mail can be sorted into an order corresponding to the carrier route by means of a small-sized sorting apparatus having about 10 stacking sections. Moreover, the thickness of each sheet or the like 2 is measured, and the address code 15 is processed along with this thickness, so that sheets or the like 2 exceeding the number which can be supplied to the feeder means 1 at once can be divided into some sets to be processed, and so that carrier route sequencing of all the sheets or the like 2 can be accordingly performed. Furthermore, overflowing of sheets or the like 2 from a stacking section of the first stacking means 11 in the process of carrier route sequencing operation is predicted, and a plurality of stacking sections are allotted in place of the stacking section in question, thereby preventing such overflowing.

Figure 22:
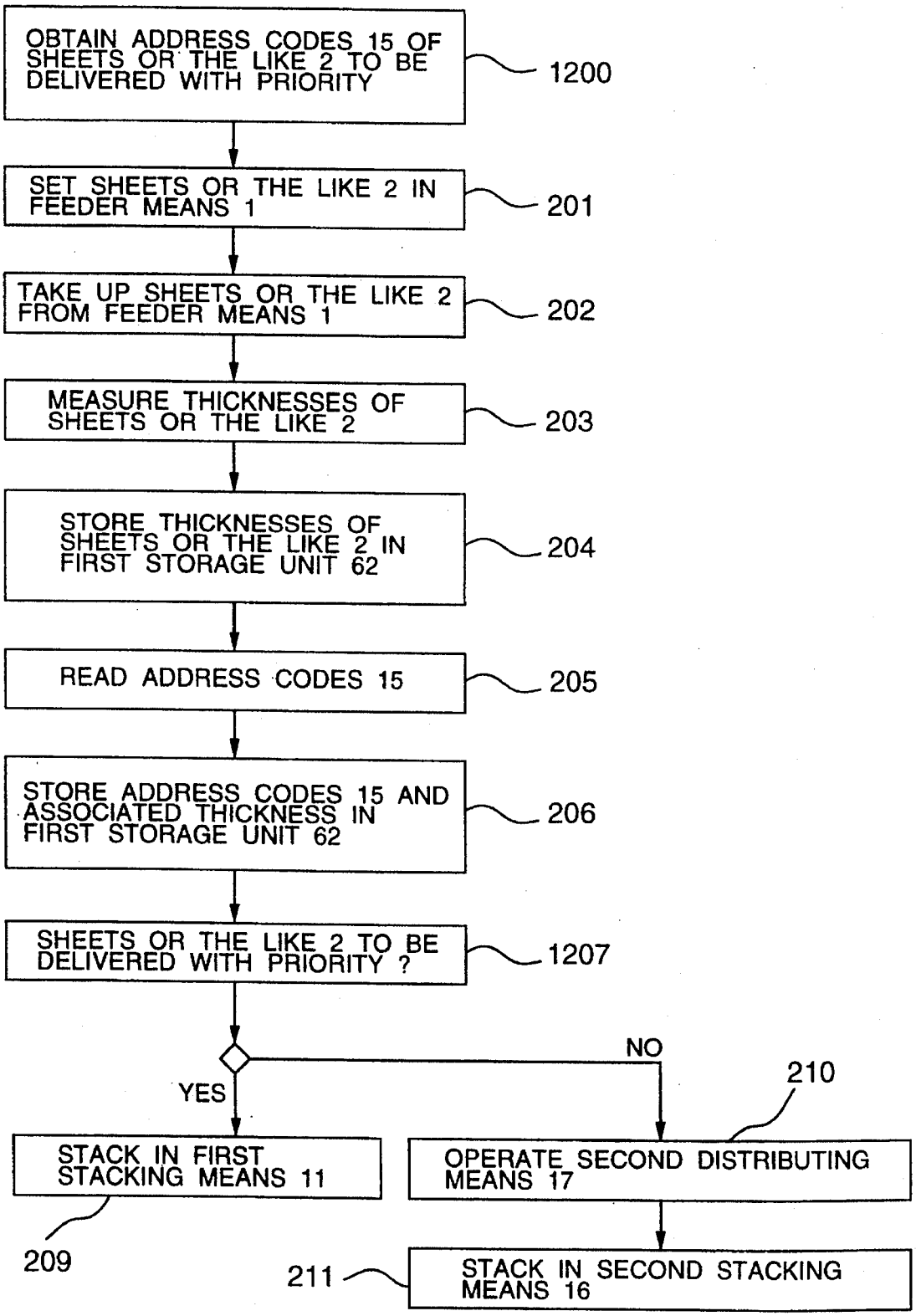
FIG. 22 is a flow chart showing operation procedures of another embodiment of a sheet or the like sorting apparatus according to the invention.

As another embodiment, there will be described the structure in which when mail per carrier is sequenced into mail to be delivered with priority and mail to be delivered normally, carrier route sequencing of the mail with priority is performed ahead of the other mail. Referring to FIG. 22, address codes 15 of sheets or the like 2 to be delivered with priority are obtained from sorting information input means 71 (step 1200). Operations from step 201 to step 206 are the same as those of the embodiment described with reference to FIG. 19. Next, it is judged whether each sheet or the like 2 is a sheet or the like 2 to be delivered with priority or not (step 1207). If it is the sheet or the like 2 to be delivered with priority, it is stacked in the first stacking means 11 (step 209). If not, the second distributing means 17 are operated (step 210), and the sheet or the like 2 is stacked in the second stacking means 16 (step 211).

With such a structure, only the sheets or the like 2 to be delivered with priority can be stacked in the first stacking means 11, and when processing of step 101 and the following steps in FIG. 17 is subsequently carried out, carrier route sequencing of the sheets or the like 2 with priority can be performed ahead of the others.

In the embodiments of the present invention, the thickness of all the sheets or the like 2 is measured. However, if the thickness of the sheets or the like 2 is found beforehand, the thickness measuring means 18 can be omitted. For example, in the case of a sheets or the like sorting apparatus which exclusively sorts postal cards, thickness measurement can be omitted, and the known thickness of postal cards can be used as the thickness of the sheets or the like 2.

As a further embodiment, there will be described one example of means for shifting sheets or the like 2 from the first stacking means 11 to the feeder means 1 without human labor.

In this embodiment, as shown in FIG. 1, the bottom plate 12 is movably supported. When the bottom plate 12 is moved backwardly, the boundary between the first stacking means 11 and the feeder means 1 disappears, and the sheets or the like 2 stacked in the first stacking means 11 fall down into the feeder means 1 without changing the order in which they were stacked in the first stacking means 11.

For example, referring to FIG. 10, when the bottom plate 12 of the first stacking means 11 is moved and pulled out, all the sheets or the like 2 stacked in the stacking sections S1 to S12 of the first stacking means 11 fall down into the feeder means 1 in unchanged order so that the same condition shown in FIG. 11 can be obtained. That is to say, referring to FIG. 18, in the operation of shifting the sheets or the like 2 to the feeder means 1 (step 118), the bottom plate 12 of the first stacking means 11 is moved and pulled out so as to move the sheets or the like 2 to the feeder means 1.

Figure 23:
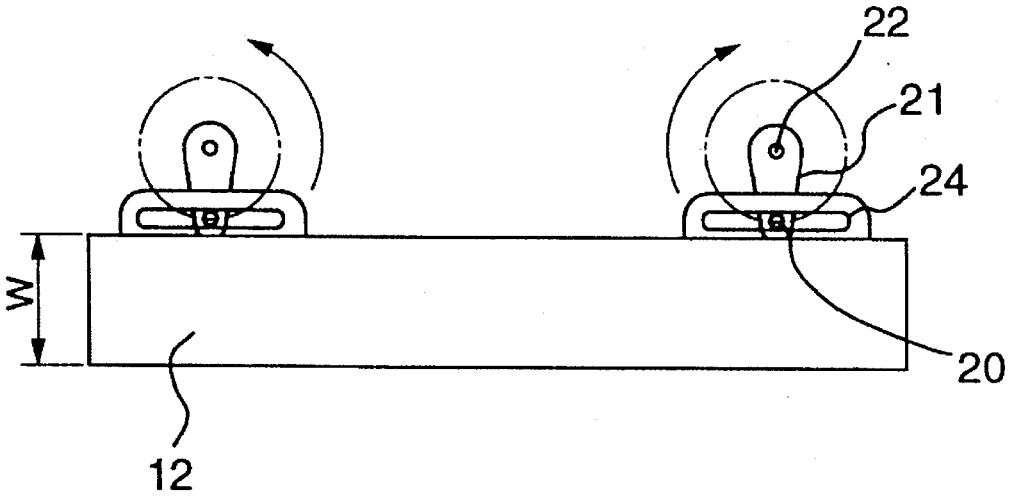
FIG. 23 is a plan view showing one example of the structure for moving a bottom plate of the sheet or the like sorting apparatus according to the invention.
Figure 24:
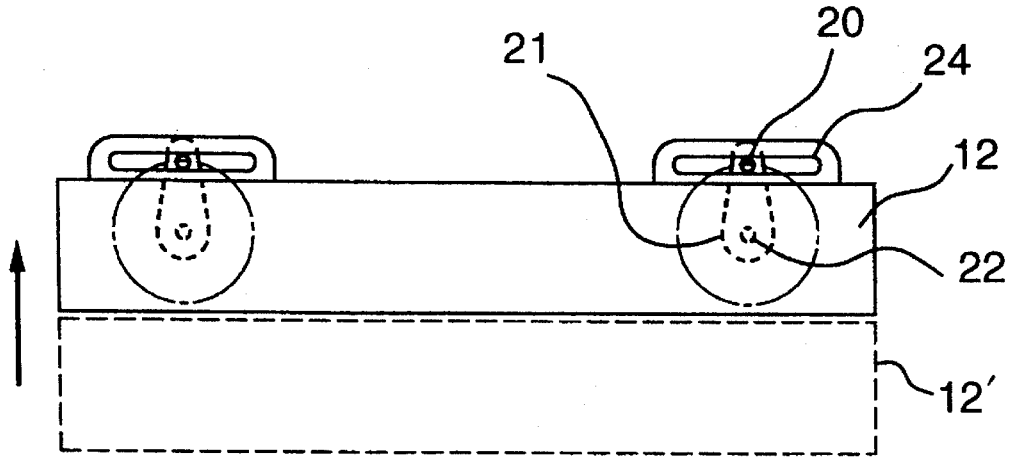
FIG. 24 is a plan view showing the operation of the example of the structure for moving the bottom plate of the sheet or the like sorting apparatus according to the invention shown in FIG. 23.

FIGS. 23 and 24 are plan views showing one example of the structure for moving the bottom plate 12. In FIG. 23, reference numeral 24 denotes a slit provided on the bottom plate 12, 21 denotes a cam which rotates around a rotation axis 22, and 20 denotes a pin provided on one end of cam which is supported to be able to slide along the slit 24.

FIG. 24 shows the condition in which the cams 1 are rotated 180° about the rotation axes 22. When the cams 21 are rotated about the rotation axes 22, the pins 20 are moved toward the rotation axes 22 of the cams 21 because the pin 20 is supported to be able to move along the slit 24, and consequently, the whole bottom plate 12 is moved toward the rotation axes 22 of the cams 21. In this case, the distance of the movement of the bottom plate 12 is the rotation diameter of the cam 21, i.e., twice as large as the distance between the rotation axis 22 and the pin 20. In accordance with the required distance of the movement of the bottom plate 12, the rotation diameter of the cam 21 can be determined.

In this embodiment, rotational cams are employed. However, the present invention is not limited to such a structure. For example, linear movement means by use of air pressure or hydraulic pressure may be employed.

A still other embodiment of means for shifting sheets or the like 2 from the first stacking means 11 to the feeder means 1 without human labor will be described with reference to FIGS. 25 to 28.

In FIGS. 25 to 28, reference numeral 40 denotes a bottom plate of the feeder means 1, **43*a* and 43*b* denote links which can be pivotally moved around a fixed rotation axis 41, 44*a* and 44*b* denote links each having one end pivotally supported at a rotation axis 45 fixed on the bottom plate 40 whereas the other ends of the links 44*a* and 44*b* are pivotally supported by the links 43*a* and 43*b* through connecting axes 42*a* and 42*b***, respectively.

Figure 25:
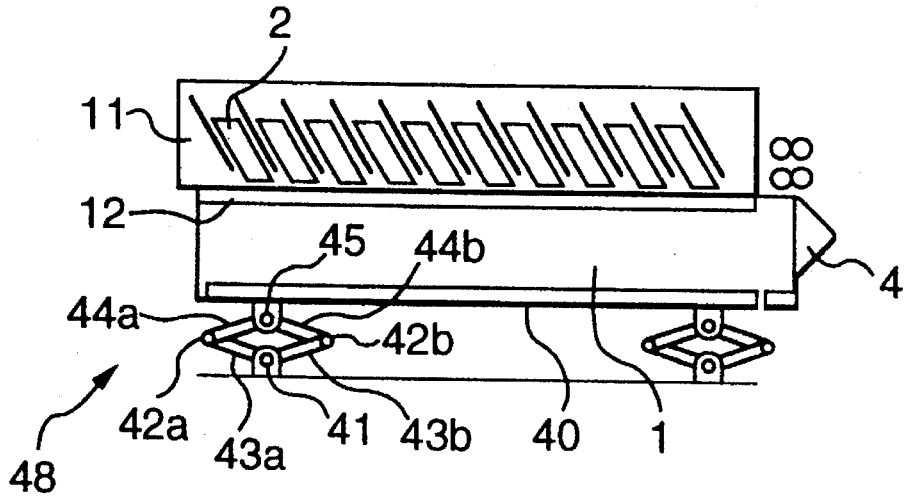
FIG. 25 is a front view showing one embodiment of means for shifting sheets or the like from first stacking means to feeder means according to the present invention.
Figure 26:
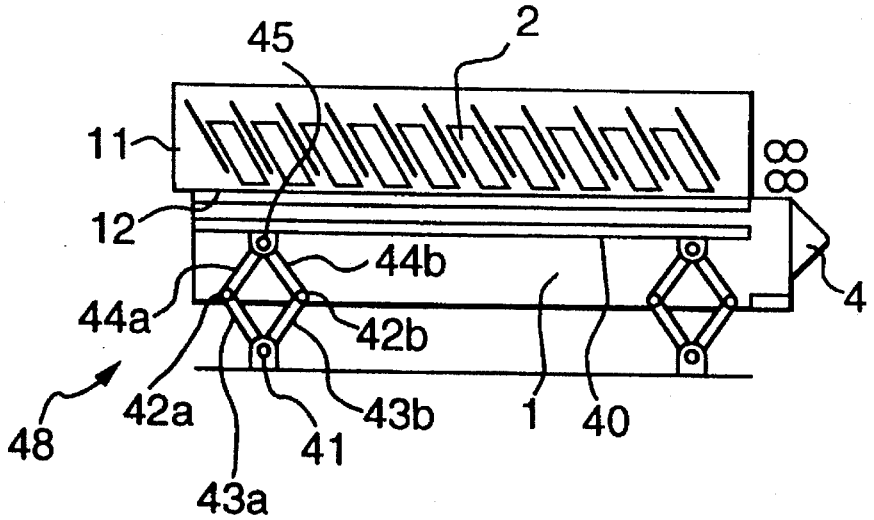
FIG. 26 is a front view showing the operation of the embodiment of the means for shifting sheets or the like from the first stacking means to the feeder means shown in FIG. 25.
Figure 27:
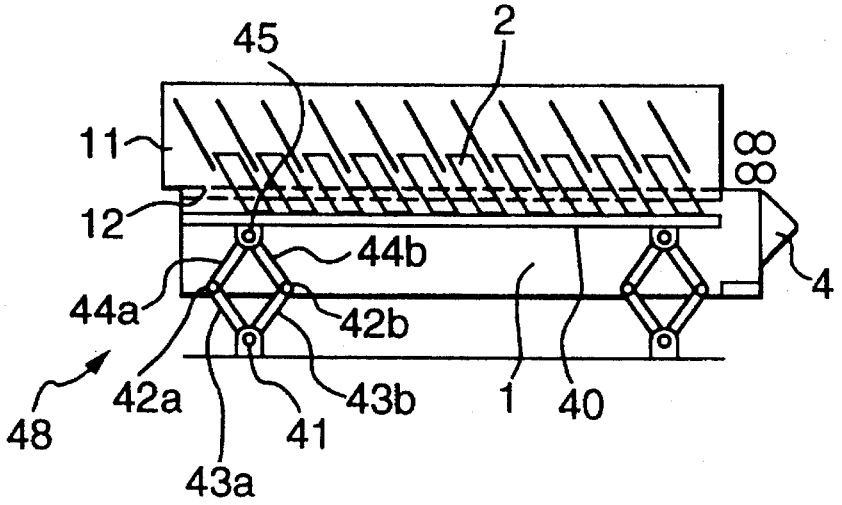
FIG. 27 is a front view showing the operation of the embodiment of the means for shifting sheets or the like from the first stacking means to the feeder means shown in FIG. 25.
Figure 28:
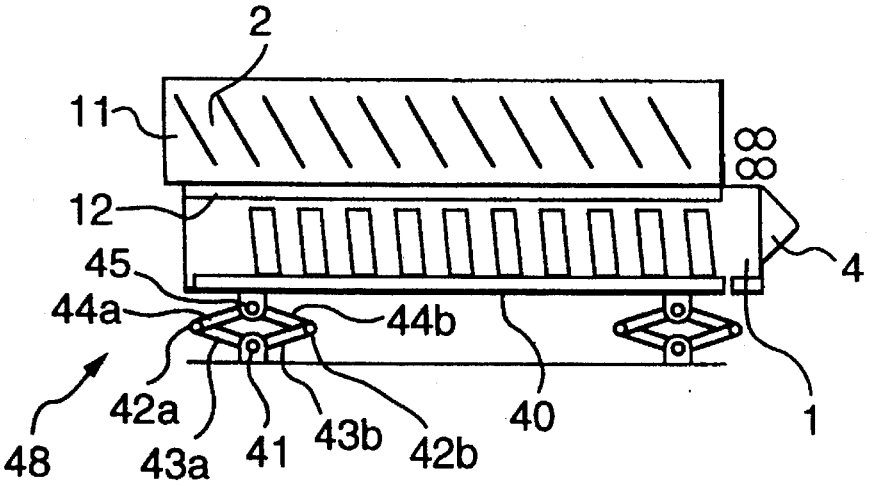
FIG. 28 is a front view showing the operation of the embodiment of the means for shifting sheets or the like from the first stacking means to the feeder means shown in FIG. 25.

FIG. 25, similar to FIG. 10 or 12, shows a condition in which sheets or the like 2 are sorted to and stacked in the first stacking means 11. Next, when the links **43*a* and 43*b* are moved inwardly toward each other, as shown in FIG. 26, the bottom plate 40 of the feeder means 1 is raised. As shown in FIG. 27, when the bottom plate 12 of the first stacking means 11 is pulled out by, for example, the structure shown in FIGS. 23 and 24, the sheets or the like 2 which have been stacked in the first stacking means 11 fall down onto the bottom plate 40 of the feeder means 1. After that, the bottom plate 40 of the feeder means 1 is lowered to the position shown in FIG. 25, and the bottom plate 12 of the first stacking means 11 is returned to the original position. In consequence, the sheets or the like 2 are shifted into the feeder means 1, as shown in FIG. 28, so that they can be fed to the separation means 4 again. FIG. 28 shows the same condition as shown in FIG. 11 or 13 or 15. In FIGS. 25 to 28, the structure with the links is shown. However, the present invention is not limited to such a structure. An actuator or the like for linear movement may be employed to move the bottom plate 40 of the feeder means 1**.

In the case of the structure shown in FIGS. 23 and 24 in which the sheets or the like 2 are shifted from the first stacking means to the feeder means 1 by merely pulling out the bottom plate 12, the distance of falling down of the sheets or the like 2 corresponds to the height of the feeder means 1, and consequently, it is feared that sheets or the like 2 having low rigidity may buckle when they fall down. However, in the case of the structure shown in FIGS. 25 to 28, the distance of falling down of the sheets or the like 2 is only the remainder of the height of the feeder means 1 after the distance of upward movement of the bottom plate 40 of the feeder means 1 is subtracted, so that buckling of the sheets or the like 2 is prevented, and so that the sheets or the like 2 can be reliably shifted from the first stacking means to the feeder means 1.

Figure 29:
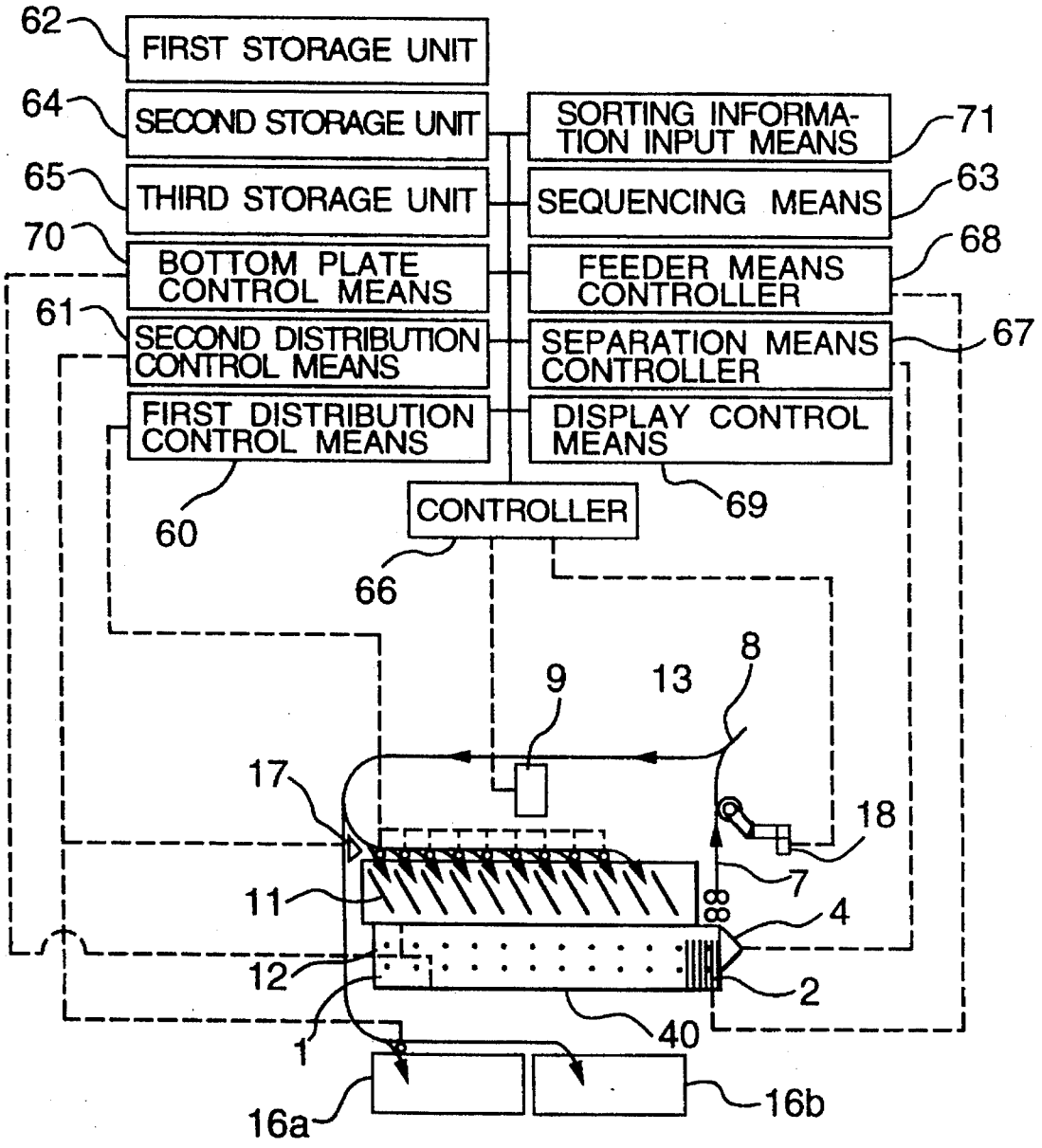
FIG. 29 is a block diagram showing the structure of another embodiment of a sheet or the like sorting apparatus according to the present invention.

FIG. 29 is a block diagram showing the structure of one embodiment of a sheet or the like sorting apparatus having means for shifting sheets or the like 2 from the first stacking means 11 to the feeder means 1 without human labor. This embodiment is only different from that shown in FIG. 16 in that it includes a bottom plate control unit 70 for controlling means for pulling out the bottom plate 12 of the first stacking means 11, and means for raising and lowering the bottom plate 40 of the feeder means 1.

In the sheets or the like sorting apparatus according to the present invention, for example, sheets or the like 2 whose address codes 15 could not be read normally and sheets or the like 2 which were judged to be unsuitable for conveyance are discharged from the conveyer passage and stacked in the sheets or the like discharge portion 10 when the carrier route sequencing is completed. The sheets or the like 2 thus discharged must be inserted in certain places between the other sheets or the like 2 in the serial order of the address codes 15 manually by an operator after the carrier route sequencing is completed. At this time, the address codes 15 or hand-written addresses of the sheets or the like 2 after carrier route sequencing must be read one by one by visual observation of the operator in order to search the places where such sheets or the like 2 are to be inserted.

Figures 30, 32:
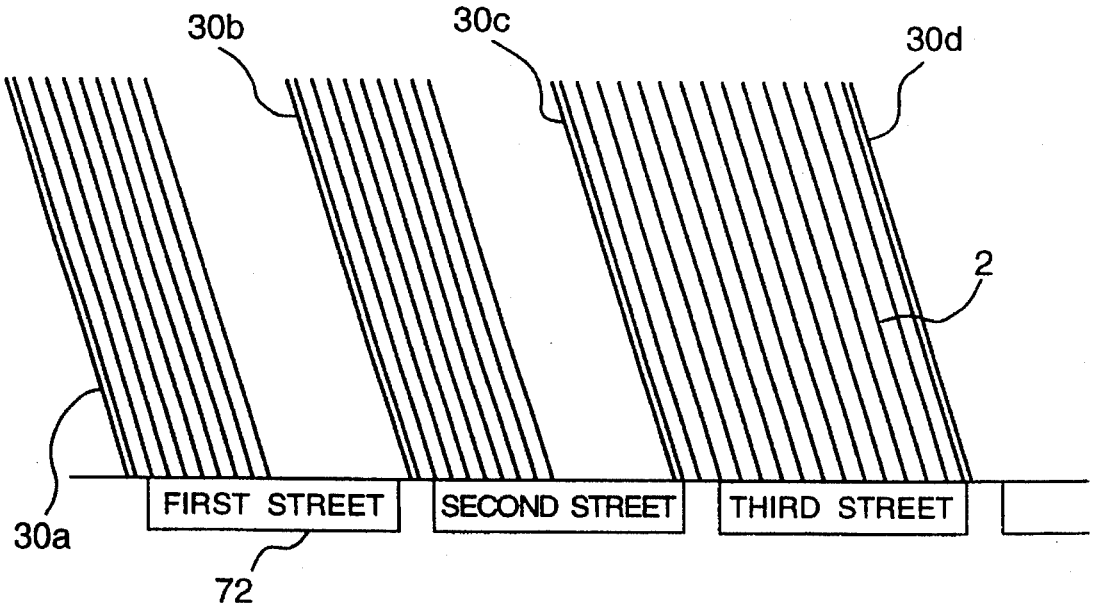
FIG. 30 is a diagram showing one example of the display contents in display means used for the sheet or the like sorting apparatus according to the invention.
FIG. 32 is a diagram showing another example of the display contents in display means used for the sheet or the like sorting apparatus according to the invention.

FIG. 30 is a diagram showing one embodiment of display means for displaying a sorting completed state when carrier route sequencing is completed. FIG. 30 shows one embodiment of the display contents of the display means 14 of FIG. 1. As shown in FIG. 30, it is one example of display of the stacking sections when carrier route sequencing is completed, and ranges of addresses of the sheets or the like 2 stacked in the respective stacking sections. When an address of a sheet or the like 2 to be inserted manually is read and compared with the sorting results, it can be found which stacking section this sheet or the like must be inserted into.

Figure 31:
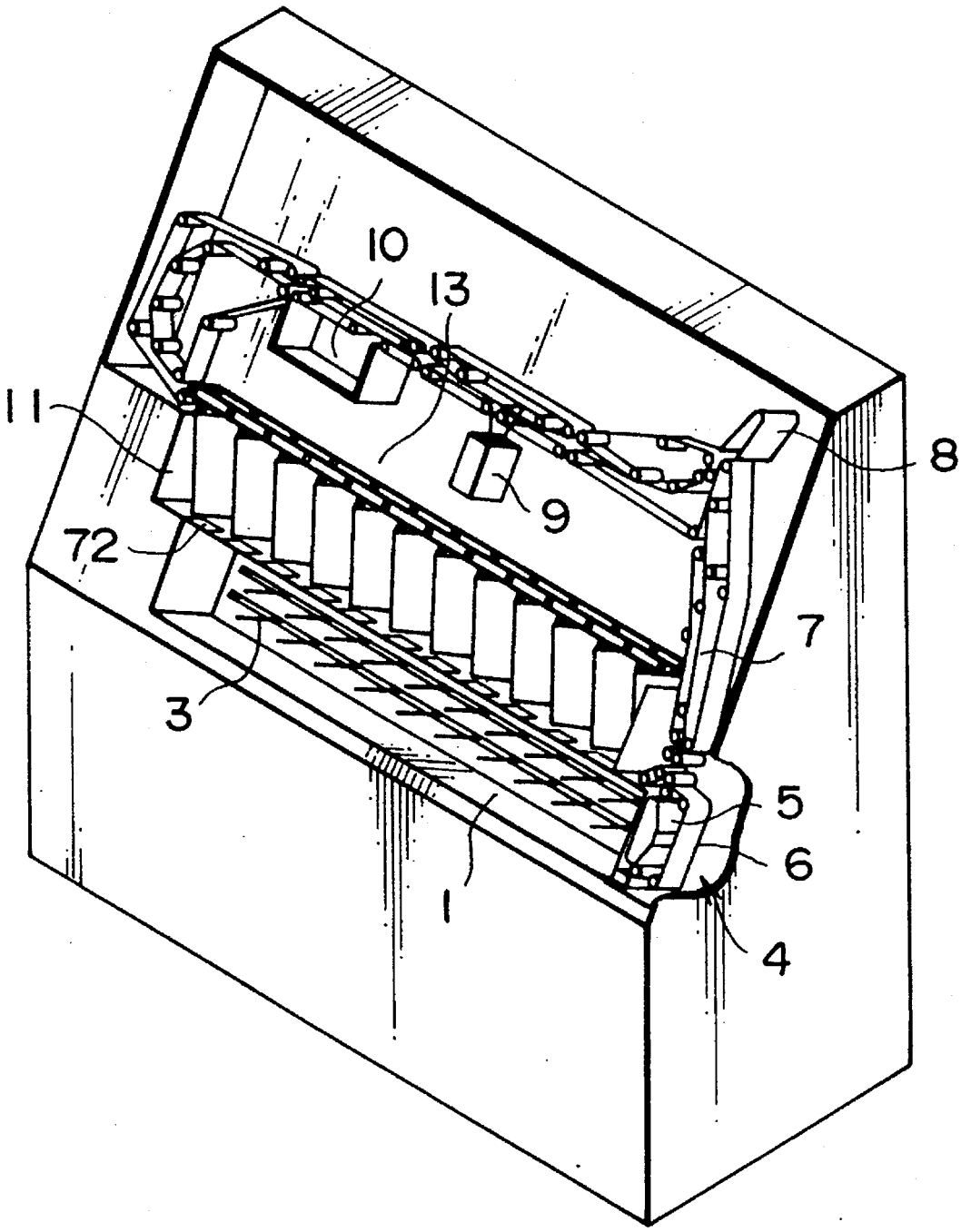
FIG. 31 is a perspective view showing a further embodiment of a sheet or the like sorting apparatus according to the invention.

FIGS. 31 and 32 are diagrams showing another embodiment of display means for displaying a sorting completed state. In FIG. 31, reference numeral 72 denotes display means corresponding to each of the stacking sections S1 to S12, which are provided in the vicinity of the stacking section. Display control means 69 control the display contents of the display means 72. FIG. 32 shows one example of the display contents of the display means 72, showing ranges of addresses of the sheets or the like 2 sorted and stacked in the respective stacking sections S1 to S12 when the sorting is completed. When an address of a sheet or the like 2 to be inserted manually is read and compared with the displayed sorting results, it can be found which stacking section this sheet or the like must be inserted into. In this embodiment, individual display means 72 are provided for each of the stacking sections. However, display means may be provided for, for example, every two adjacent stacking sections.

In the case where sheets or the like of an address code 15 have a plurality of delivery points, their hand-written addresses must be read for confirmation by visual observation of an operator after carrier route sequencing in the serial order of the address codes 15 has been finished, and the sheets or the like must be sequenced in accordance with the delivery points. In such a case, address codes 15 which require confirmation are inputted in advance by the sorting information input means 71, and a stacking section including such address codes can be easily found by different display means, for example, lighting an indicator lamp, or blinking display of the display means 14 or 72 corresponding to the stacking section in question, or displaying information in a different color.

According to the present invention, over flowing of sheets or the like from the stacking means can be prevented by properly restricting the number of sheets or the like to be fed at one time on the basis of the thickness and the amount of sheets or the like.

The stacking means of sheets or the like are provided on an upper portion of the feeder means, and the sheets or the like can be recovered from the stacking means by letting the sheets or the like fall down into the feeder means. Therefore, the sheets or the like need not be shifted for sequencing from the stacking means into the feeder means by human labor, and also, the sheets or the like can be moved in an extremely short period of time, which results in an advantage that time required for the sequencing operation can be shortened.

Display of sorting information of each stacking section when the sequencing is completed is useful, for example, when the sheets or the like which have been discharged from the sheets or the like sorting apparatus are inserted in certain places. Moreover, when a plurality of sheets or the like having an address code must be sequenced by visual observation and confirmation of an operator, the address code in question is inputted in advance so that an indication can be displayed of which stacking section these sheets or the like are stacked in when the sequencing is completed, and such display will be the sign for the operation by the person in charge.

According to the embodiments of the present invention, sheets or the like on which address codes are printed, e.g., mail, can be sequenced in the serial order designated by the address codes, by means of a small-sized sorting apparatus having about 10 stacking sections. For example, the address codes express delivery points of mail, and the order of the address codes is associated with the carrier route of the mail, so that the mail fed to the sorting apparatus can be sequenced in accordance with the carrier route.

The stacking means are provided on an upper portion of the feeder means, and the mail are stacked in substantially standing positions in the stacking means. Thus, the width of the stacking means can be made substantially equal to that of the feeder means, and the longitudinal length of the whole sorting apparatus can be about 2 m. Both the width of the stacking means and the width of the feeder means are not more than 2 m so that an operator can reach the mail in the stacking means and the feeder means by hand without moving around, thereby lessening the labor of the operator.

Moreover, because the stacking means are provided on the upper portion of the feeder means, means like a tray for shifting mail are not necessary when the mail sorted to and stacked in the stacking means are supplied to the feeder means again. The mail is simply moved from the stacking means on an upper shelf to the feeder means on a lower shelf. Therefore, even if the mail is manually shifted from the stacking means to the feeder means, the shifting operation is easy.

Furthermore, because the stacking means and the feeder means are located one above the other and in contact with each other, the mail in the stacking means can be allowed to fall down and move into the feeder means by providing means for opening the bottom surface of the stacking means. With such an arrangement, the sorted mail can be supplied to the feeder means without manual operation, thus enabling automatic sequencing of the mail in accordance with the carrier route order.

In the above-described embodiments, sheets or the like are held in standing positions. However, the present invention can be applied to the case where sheets or the like are placed in horizontal positions.

What is claimed is:

1. An apparatus for sorting sheet-like items having address codes thereon, each sheet-like item having a top edge, a bottom edge, a first side edge, and a second side edge, said apparatus comprising feeder means for holding a plurality of sheet-like items in standing positions in which each sheet-like item is standing on one of its top edge and its bottom edge; separation means for taking up the items one by one from the feeder means; address code reading means for reading the address codes on the items which have been taken up by the separation means; stacking means positioned above the feeder means, said stacking means including a plurality of stacking sections in which the items are to be stacked in standing positions; conveyer means, including reversing means, for conveying the items from the separation means to the reversing means with each item conveyed with its first side edge as leading edge, and for conveying the items from the reversing means to the stacking means with each item conveyed with its second side edge as leading edge; and sorting means for sorting each of the items to one of the stacking sections of the stacking means in accordance with the address code on such item as read by the address code reading means.

2. An apparatus according to claim 1, wherein said stacking means includes shifting means for shifting the items, while the items are in substantially standing position, into the feeder means so that the items are held in the standing positions and moved to the separation means without changing the order of the items when the items are sorted to the stacking sections of the stacking means.

3. An apparatus according to claim 1, wherein said stacking means includes bottom-surface moving means allowing the items to fall from the stacking means down into the feeder means in standing positions.

4. An apparatus according to claim 1, further comprising display means for displaying, for each of the stacking sections, a range of address codes of items stacked in such stacking section when sorting of the items is completed.

5. An apparatus as claimed in claim 1, further comprising display means corresponding to respective stacking sections and provided in the vicinity of the stacking sections, for displaying address codes of items stacked in the said respective stacking sections when sorting of the items is completed.

6. An apparatus as claimed in claim 1, further comprising transfer means between the stacking means and the feeder means, for transferring the items from the stacking means to the feeder means.

7. An apparatus for sorting sheet-like items having address codes thereon, each sheet-like item having a top edge, a bottom edge, a first side edge, a second side edge, a front surface, and-a back surface, said apparatus comprising feeder means for holding a plurality of sheet-like items in standing positions in which each sheet-like item is standing on one of its top edge and its bottom edge; separation means for taking up the items one by one from the feeder means; first address code reading means for reading address codes applied to the front surfaces of the items which have been taken up by the separation means; second address code reading means for reading address codes applied to the back surfaces of the items which have been taken up by the separation means; stacking means positioned above the feeder means, said stacking means including a plurality of stacking sections in which the items are to be stacked in standing positions; conveyer means for conveying the items from the separation means to the stacking means; and sorting means for sorting each of the items to one of the stacking sections of the stacking means in accordance with the address code on such item as read by the first address code reading means or the second address code reading means.

8. An apparatus for sorting sheet-like items having address codes thereon, each sheet-like item having a top edge, a bottom edge, a first side edge, and a second side edge, said apparatus comprising feeder means for holding a plurality of sheet-like items in standing positions in which each sheet-like item is standing on one of its top edge and its bottom edge; separation means for taking up the items one by one from the feeder means; address code reading means for reading the address codes on the items which have been taken up by the separation means; stacking means positioned above the feeder means, said stacking means including a plurality of stacking sections in which the items are to be stacked in standing positions; conveyer means for conveying the items from the separation means to the stacking means; and sorting means for sorting each of the items to one of the stacking sections of the stacking means in accordance with the address code on such item as read by the address code reading means, said stacking means including bottom-surface moving means for moving the bottom surface of the stacking means to allow the items to fall from the stacking means down into the feeder means in standing positions, said feeder means including moving means for moving the items in standing positions toward the separation means.

9. An apparatus for sorting sheet-like items having address codes thereon, each sheet-like item having a top edge, a bottom edge, a first side edge, and a second side edge, said apparatus comprising feeder means for holding a plurality of sheet-like items having address codes thereon; separation means for taking up the items one by one from the feeder means; address code reading means for reading the address codes on the items which have been taken up by the separation means; stacking means positioned above the feeder means, said stacking means including a plurality of stacking sections in which the items are to be stacked; conveyer means for conveying the items from the separation means to the stacking means; and sorting means for sorting each of the items to one of the stacking sections of the stacking means in accordance with the address code on such item as read by the address code reading means, said stacking means including first bottom-surface moving means for moving the bottom surface of the stacking means to allow the items to fall from the stacking means down into the feeder means, said feeder means including second bottom-surface moving means for raising the bottom surface of the feeder means toward the bottom surface of the stacking means and returning the bottom surface of the feeder means to the original position thereof.

10. An apparatus for sorting sheet-like items having address codes thereon, each sheet-like item having a top edge, a bottom edge, a first side edge, and a second side edge, said apparatus comprising feeder means for holding a plurality of sheet-like items in standing positions in which each sheet-like item is standing on one of its top edge and its bottom edge; separation means for taking up the items one by one from the feeder means; address code reading means for reading the address codes on the items which have been taken up by the separation means; first stacking means positioned above the feeder means, said first stacking means including a plurality of stacking sections in which the items having address codes within a first processing segment are to be stacked in standing positions, the first stacking means including means for shifting the items to the feeder means; conveyer means for conveying the items from the separation means to the first stacking means; first distributing means for distributing items to the stacking sections of the first stacking means in accordance with the address codes which have been read by the address code reading means; second stacking means for stacking items whose read address codes are not in the first processing segment are to be stacked; and second distributing means for distributing the last-named items to the second stacking means.

11. An apparatus according to claim 10, wherein the feeder means can hold the number of items belonging to each of the processing segments at one time.

12. An apparatus according to claim 10, further comprising thickness measuring means for measuring the thicknesses of the items; a first storage unit for storing the measured thicknesses of the items and the read address codes of the items; sequencing means for sequencing the address codes and the thicknesses of the items in the first storage unit into serial order according to the address codes; a second storage unit for storing the address codes and the thicknesses of the items as sequenced by the sequencing means; and control means responsive to the total thickness of the items being larger than the thickness which can be placed in the feeder means at one time, for dividing the address codes stored in the second storage unit into a plurality of processing segments, the first processing segment including read address codes of the items within a group in the serial order having a group thickness not greater than the thickness which can be placed in the feeder means at one time.

13. An apparatus for sorting sheets or the like according to claim 12, wherein the control means divides the address codes into the plurality of processing segments such that each processing segment includes read address codes of the items within a group in the serial order having a group thickness not greater than the thickness which can be placed in the feeder means at one time.

14. An apparatus as claimed in claim 12, further comprising a third storage unit for storing correspondence between the stacking sections of the first stacking means and digits of the address codes; means for applying processing segment symbols to the processing signals and storing the processing segments and processing segment symbols in the second storage unit, and wherein the control means is responsive to the total thickness of the items in a processing segment corresponding to address codes having a common digit in any of a plurality of positions of the address codes being larger than the thickness which can be stacked in each of said stacking sections, for allotting common sorting information to two stacking sections and storing the common storing information in the third storage unit.

15. An apparatus according to claim 10, further comprising thickness measuring means for measuring the thicknesses of the items; a first storage unit for storing the measured thicknesses of the items and the read address codes of the items; sequencing means for sequencing the address codes and the thicknesses of the items in the first storage unit into serial order according to the address codes; a second storage unit for storing the address codes and the thicknesses of the items as sequenced by the sequencing means; and control means responsive to read address codes items to be delivered with priority, for controlling the first distributing means to distribute such items to the first stacking means, and for controlling the second distributing means to distribute remaining items to the second stacking means.

16. An apparatus for sorting sheet-like items having address codes thereon, each sheet-like item having a top edge, a bottom edge, a first side edge, and a second side edge, said apparatus comprising feeder means for holding a plurality of sheet-like items in standing positions in which each sheet-like item is standing on one of its top edge and its bottom edge; separation means for taking up the items one by one from the feeder means; address code reading means for reading the address codes on the items which have been taken up by the separation means; stacking means positioned above the feeder means, said stacking means including a plurality of stacking sections in which the items are to be stacked in standing positions, the stacking means including means for shifting the items to the feeder means; conveyer means for conveying the items from the separation means to the stacking means; distributing means for distributing each of the items to one of the stacking sections of the stacking means in accordance with the address code on such items as read by the address code reading means; and control means responsive to a digit in a predetermined digit position of the read address codes for associating the stacking sections of the stacking means with the digits of the address code and controlling the distributing means to distribute the items to the stacking sections of the stacking means in accordance with the associated digits, and for controlling the stacking means to shift the items from the stacking means to the feeder means so that the items may be fed to the separation means again, and a series of the foregoing operations repeated.

17. An apparatus for sorting sheets or the like according to claim 16, wherein said control means is responsive to digits in the first digit position of a plurality of digit positions of the address codes in normal order or reverse order, and every time the series of operations is repeated, is responsive to digits in the next digit position to the former digit position, with the correspondence of the order of the digits of the address codes to the stacking sections reversed, and wherein said series of operations is repeated a number times equal to the number of digit positions of the address codes.

* * * * *